US008176695B2

(12) United States Patent
Deweerd et al.

(10) Patent No.: US 8,176,695 B2
(45) Date of Patent: May 15, 2012

(54) WALL PANEL FRAME ARRANGEMENT

(75) Inventors: Jason Deweerd, Allegan, MI (US); Richard Haworth, Holland, MI (US); Shane Kuipers, Hamilton, MI (US); Steven Heyer, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 425 days.

(21) Appl. No.: 11/982,890

(22) Filed: Nov. 6, 2007

(65) Prior Publication Data

US 2008/0104895 A1 May 8, 2008

Related U.S. Application Data

(60) Provisional application No. 60/857,097, filed on Nov. 6, 2006.

(51) Int. Cl.
*E04H 1/00* (2006.01)

(52) U.S. Cl. ..... 52/239; 52/220.7

(58) Field of Classification Search ..... 52/239, 52/79.1, 220.7, 238.1, 241, 242, 243
See application file for complete search history.

(56) References Cited

U.S. PATENT DOCUMENTS

| | | | | |
|---|---|---|---|---|
| 2,970,677 | A | 2/1961 | Springs et al. | |
| 3,807,102 | A | 4/1974 | Albinson | |
| 3,990,204 | A | 11/1976 | Haworth et al. | |
| 4,120,124 | A | 10/1978 | Temple et al. | |
| 4,147,198 | A * | 4/1979 | Ytter | 160/135 |
| 4,213,493 | A | 7/1980 | Haworth | |
| 4,423,573 | A | 1/1984 | Omholt et al. | |
| 4,593,505 | A | 6/1986 | Russell | |
| 4,631,881 | A | 12/1986 | Charman | |
| 4,685,255 | A | 8/1987 | Kelley | |
| 4,833,848 | A | 5/1989 | Guerin | |
| 4,891,922 | A | 1/1990 | Hozer et al. | |
| 4,905,428 | A | 3/1990 | Sykes | |
| 4,996,811 | A | 3/1991 | Dull et al. | |
| 5,062,246 | A | 11/1991 | Sykes | |
| 5,175,969 | A | 1/1993 | Knauf et al. | |
| 5,381,994 | A | 1/1995 | Welch | |
| 5,426,904 | A | 6/1995 | Gilmore | |
| 5,488,808 | A | 2/1996 | Cahill et al. | |
| 5,524,402 | A | 6/1996 | Sykes | |
| 5,555,689 | A * | 9/1996 | Gilmore | 52/489.1 |
| 5,682,719 | A * | 11/1997 | Huang | 52/775 |
| 5,797,440 | A | 8/1998 | Tsai | |
| 5,802,789 | A | 9/1998 | Goodman et al. | |
| 5,816,001 | A | 10/1998 | Goodman et al. | |

(Continued)

FOREIGN PATENT DOCUMENTS

EP 0 293 240 A2 11/1988

(Continued)

*Primary Examiner* — Branon Painter
(74) *Attorney, Agent, or Firm* — Warner Norcross & Judd LLP

(57) ABSTRACT

A wall panel frame arrangement is provided having vertical and horizontal frame rails for having a common cross-sectional profile which facilitates joining thereof at the corners of the frame. Additionally, an improved light block arrangement is provided as a rail which extends horizontally across the frame, which rail is also adaptable for use with respect to a support assembly for supporting power and data communication circuit components thereon. The bottom of the frame further includes connector arrangements which facilitate mounting of either a base raceway cover or a vertically-enlarged cover tile at the same base location of the panel frame.

17 Claims, 24 Drawing Sheets

U.S. PATENT DOCUMENTS

| | | | | |
|---|---|---|---|---|
| 5,839,240 | A | 11/1998 | Elsholz et al. | |
| 5,875,596 | A * | 3/1999 | Muller | 52/239 |
| 5,930,963 | A * | 8/1999 | Nichols | 52/239 |
| 5,943,834 | A | 8/1999 | Jeffers et al. | |
| 6,000,180 | A | 12/1999 | Goodman et al. | |
| 6,009,676 | A | 1/2000 | Feldpausch et al. | |
| 6,088,981 | A | 7/2000 | Edwards | |
| 6,115,977 | A | 9/2000 | Hornberger et al. | |
| 6,131,347 | A | 10/2000 | Hornberger et al. | |
| 6,173,545 | B1 | 1/2001 | Feldpausch et al. | |
| 6,178,702 | B1 | 1/2001 | Hand et al. | |
| 6,223,485 | B1 | 5/2001 | Beck et al. | |
| 6,389,773 | B1 * | 5/2002 | Reuter et al. | 52/582.2 |
| 6,397,533 | B1 | 6/2002 | Hornberger et al. | |
| 6,415,567 | B1 * | 7/2002 | Mead et al. | 52/239 |
| 6,435,253 | B1 | 8/2002 | Steeves et al. | |
| 6,442,909 | B2 * | 9/2002 | Waalkes et al. | 52/239 |
| 6,557,310 | B2 | 5/2003 | Marshall et al. | |
| 6,684,929 | B2 | 2/2004 | MacDonald et al. | |
| 6,748,710 | B2 | 6/2004 | Gresham et al. | |
| 6,775,953 | B2 | 8/2004 | Burken et al. | |
| 6,805,185 | B2 | 10/2004 | Gravel et al. | |
| 6,807,776 | B2 | 10/2004 | Girdwood et al. | |
| 6,883,277 | B2 * | 4/2005 | Wiechecki et al. | 52/36.6 |
| 6,889,477 | B1 | 5/2005 | Kottman | |
| 6,941,716 | B2 | 9/2005 | Kottman | |
| 6,964,138 | B2 * | 11/2005 | Carroll et al. | 52/239 |
| 7,051,482 | B2 | 5/2006 | MacDonald et al. | |
| 2002/0117270 | A1 | 8/2002 | Steeves et al. | |

FOREIGN PATENT DOCUMENTS

| | | | |
|---|---|---|---|
| FR | 2 683 842 | A1 | 5/1993 |
| JP | 4-62259 | A | 2/1992 |
| WO | WO 92/17659 | | 10/1992 |
| WO | WO 2005/078208 | A1 | 8/2005 |

* cited by examiner

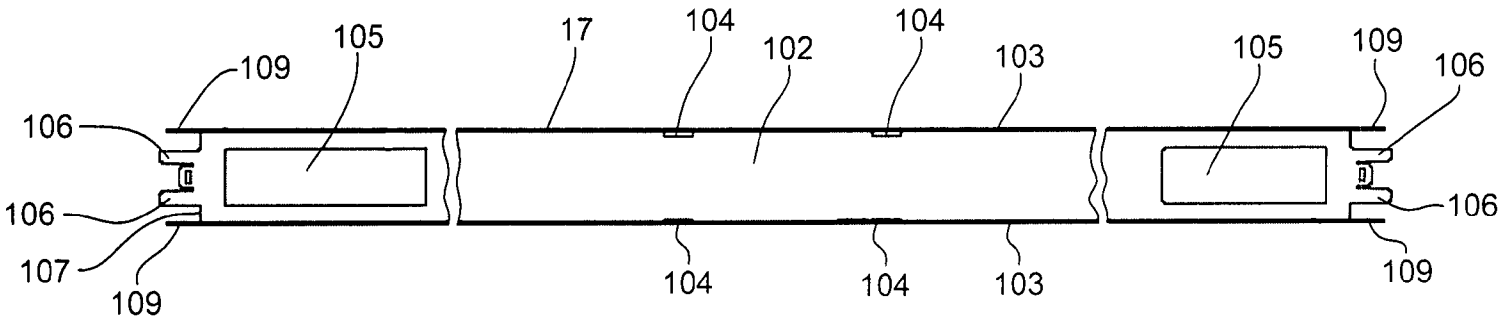
FIG. 23
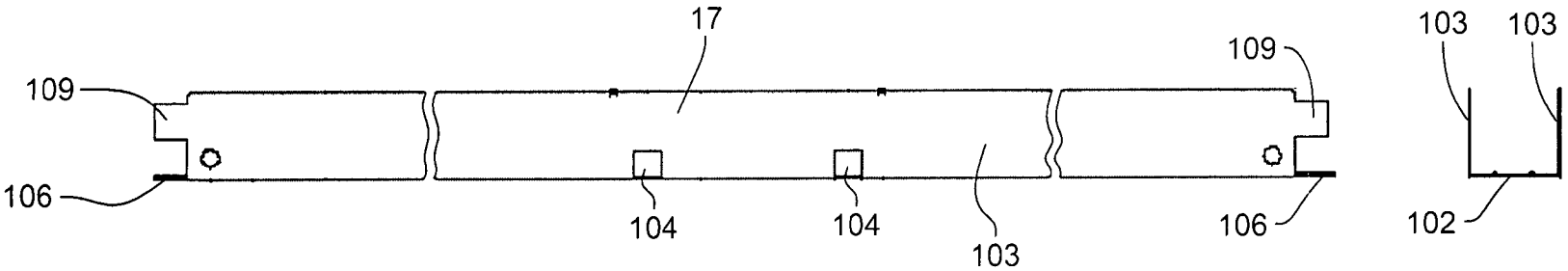
FIG. 24
FIG. 22

FIG. 35A
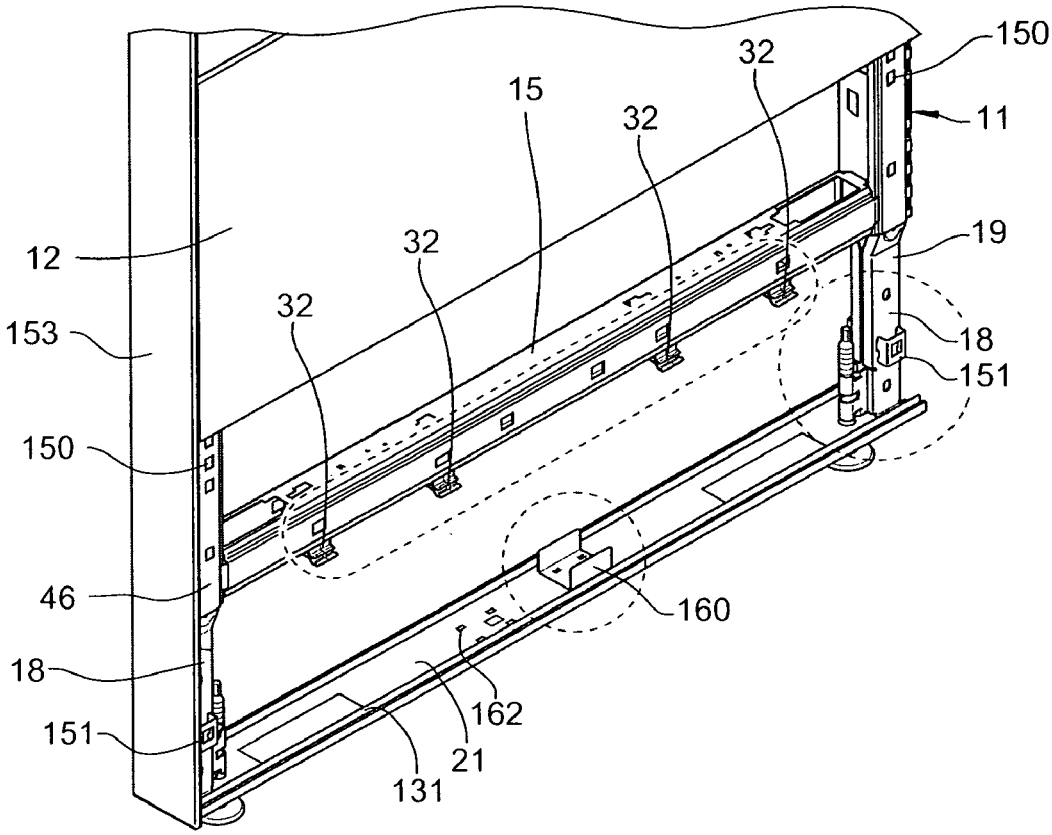
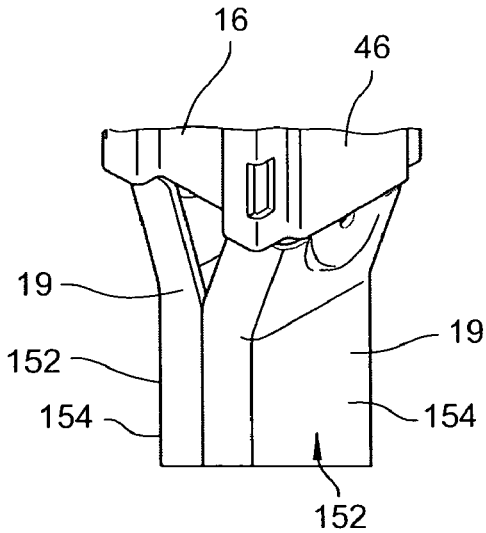
FIG. 36

WALL PANEL FRAME ARRANGEMENT

CROSS REFERENCE TO RELATED APPLICATION

This application claims the benefit of U.S. Provisional Application No. 60/857,097, filed Nov. 6, 2006, which is incorporated herein by reference in its entirety.

FIELD OF THE INVENTION

The invention relates to a space-dividing wall panel system, and particularly, the structural arrangement of the frame thereof.

BACKGROUND OF THE INVENTION

Interior wall systems formed from a plurality of upright interior panels which are typically serially joined in aligned and/or transverse relationship are conventionally utilized in offices and the like to divide large open areas into smaller work spaces. The upright wall panels are typically manufactured in the factory with final assembly occurring at the job site, which final assembly typically involves attachment of removable cover pads to opposite sides of the upright panel frame, and attachment of various trim pieces along the edges, such as a top cap along the top edge of the panel and side trim covers at the end-of-run positions and at corner connections. Interior space-dividing wall systems of the type described above generally permit panels to be joined in right-angled relationship to one another, such as L-shaped or T-shaped configurations, although the perpendicularly joined panels are typically joined at the panel edges in multi-way connections, such as two-way, three-way or four-way connections.

It is an object of the invention to provide an improved wall panel construction and in particular, an improved wall panel frame arrangement having features which facilitate the construction and use thereof.

In this regard, an improved frame arrangement is constructed from common frame tubes having a common cross-sectional profile which permits the frame tubes to be used to define both vertical and horizontal frame rails. These frame rails include integral flanges serving as both weld flanges and gussets and are connected together by welding to provide an improved structurally rigid frame construction.

Additionally, a light block is provided as a horizontal rail which is readily mountable to the vertical frame rails without requiring separate fasteners therefor. These light block rails align with horizontal edges of cover tiles so as to visually block the space between any gaps formed between the cover tiles on one side of the panel frame and the cover tiles provided on the opposite side of the panel frame. Additionally, the frame is provided with an improved assembly for supporting power and data communication hardware within the panel frame.

Still further, an improved arrangement is provided for alternatively connecting a base raceway cover or a cover tile to the panel frame. Overall, the frame arrangement of the invention provides a wall panel construction which overcomes disadvantages associated with prior art wall panel systems.

Other objects and purposes of the invention, and variations thereof, will be apparent upon reading the following specification and inspecting the accompanying drawings.

BRIEF DESCRIPTION OF THE DRAWINGS

FIG. 22 is a front view of the light block rail.

FIG. 23 is a plan view thereof.

FIG. 24 is an end view thereof.

FIG. 35A is a fragmentary perspective view illustrating the mounting arrangement for a bottom cover tile in place of the base raceway cover.

FIG. 36 is an enlarged fragmentary perspective view illustrating a leg support bracket and its connection to a vertical frame rail.

Figure 1:
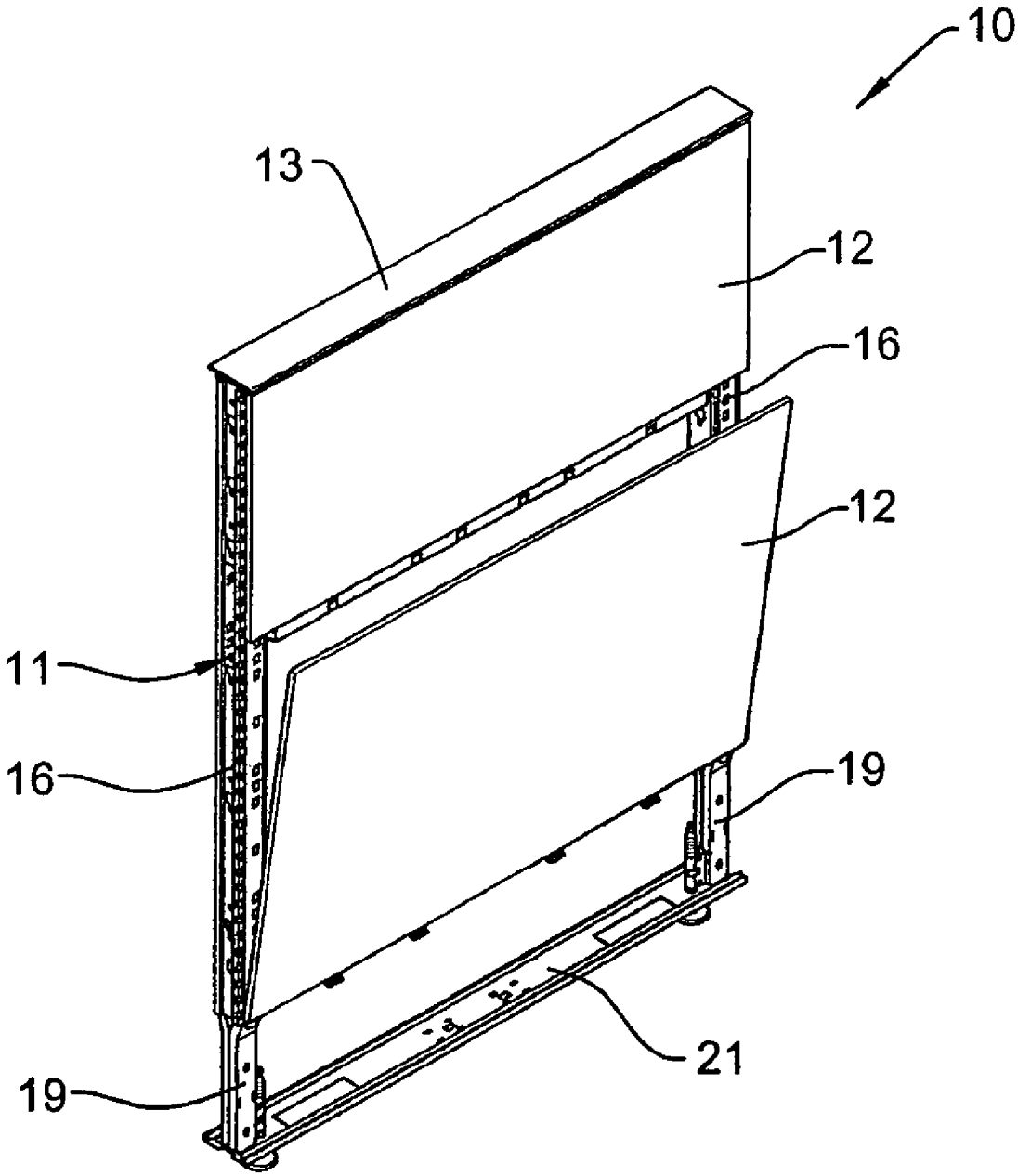
FIG. 1 is a perspective view of an upright wall panel of this invention.

Certain terminology will be used in the following description for convenience and reference only, and will not be limiting. For example, the words "upwardly", "downwardly", "rightwardly" and "leftwardly" will refer to directions in the drawings to which reference is made. The words "upper" and "lower" will also refer to portions of the panel when in its normal vertically-oriented position of use. The words "inward" and "outward" will refer to directions toward and away from, respectively, the geometric center of the panel and designated parts and assemblies associated therewith. Said terminology will include the words specifically mentioned, derivatives thereof, and words of similar import.

DETAILED DESCRIPTION

Referring to FIG. 1, there is illustrated an upright space-dividing wall panel 10 of the type used for creating an upright wall system, which system involves joinder of several such panels in adjacent aligned and/or transverse relationship for at least partially enclosing workspaces and the like. The use of upright wall panels, and the joinder of a plurality of such panels in aligned and/or transverse relationship to define workspaces and the like, is a well known and extensively utilized practice, whereby further description and discussion thereof is believed unnecessary.

Figure 2:
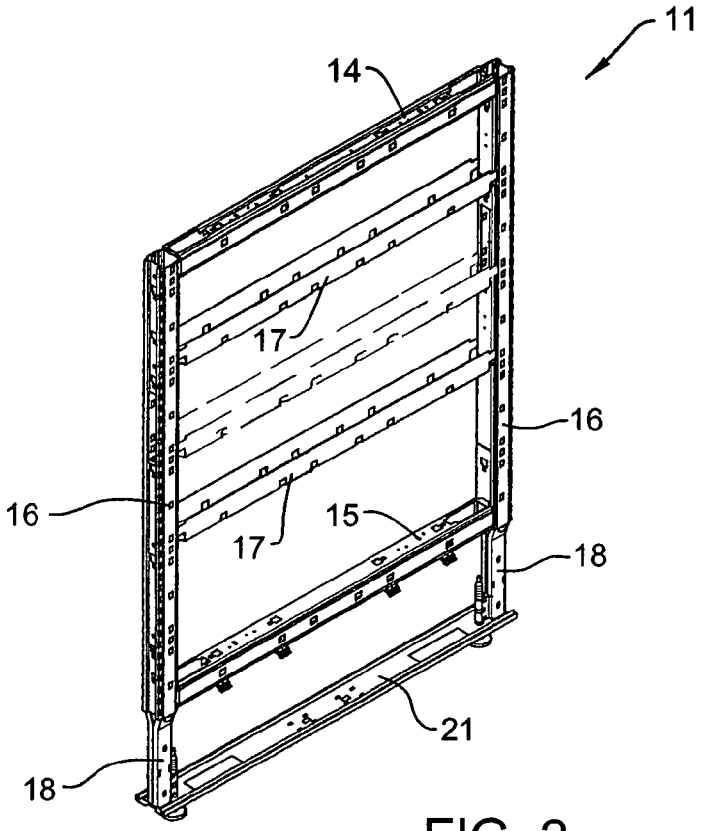
FIG. 2 is a perspective view of solely the rigid interior frame as associated with the upright wall panel of FIG. 1, the side cover pads being removed for clarity of illustration.

The wall panel 10, as illustrated by FIG. 2, includes an interior upright frame 11 which, as is also known, is adapted to removably mount one or more cover pads or tiles 12 on opposite side faces of the frame. The wall panel 10 of this invention is provided with an improved structural top cap arrangement, the latter specifically including an elongate top cap 13, which rigidly couples to and extends lengthwise along the upper edge of the interior frame 11.

The interior frame 11 may assume other known constructions but, in the illustrated embodiment, is of a generally open but rectangular rigid construction defined by horizontally elongated and vertically spaced top and bottom frame rails 14 and 15, respectively, which frame rails in turn are rigidly joined adjacent opposite ends thereof by upright edge or side rails 16 which extend vertically in generally perpendicular relationship to the horizontal rails 14-15. The frame rails 14, 15 and 16, in the illustrated and preferred construction, are rigidly joined, preferably by welding, and each is preferably formed from an elongate hollow metal tube having a cross-section which is generally rectangular and more specifically generally square. The frame rails, including specifically the uprights 16, are provided with openings through the side faces thereof which, in a conventional manner, accommodate clips or hooks provided on the cover pads 12 for permitting the cover pads to be attached to the frame substantially in engagement with the side faces thereof. The frame 11 as illustrated by FIG. 2 may also be provided with intermediate horizontally extending cross-rails or beams 17 which can be either permanently or removably engaged with the uprights 16, whereby the number and location of such crossbeams can be selected in accordance with the mode of usage of the upright wall panel, the size and number of cover pads provided on the side faces thereof, and the types and locations of cooperating accessory structures.

Figure 3:
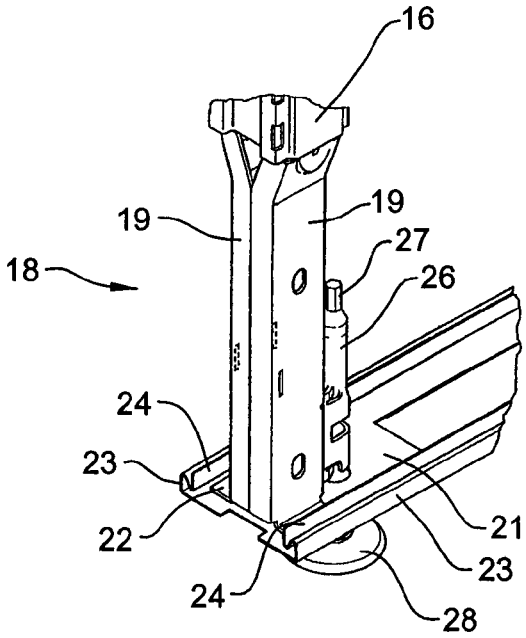
FIG. 3 is an enlarged fragmentary perspective view showing a lower corner portion of the frame illustrated in FIG. 2.

In the frame 11 as illustrated by FIGS. 2 and 3, each of the uprights 16 has a lower end part 18 which is configured to define an open interior raceway extending horizontally along the panel adjacent the lower edge thereof for accommodating telecommunication and/or electric cabling therein. This lower end part 18, to provide clearance for cabling which extends horizontally between adjacent panels, is defined generally by platelike side members 19 which protrude upwardly and are joined generally back-to-back, thereby providing clearance for cables adjacent opposite side faces thereof. This lower leg part 18 rigidly joins to a horizontally elongate member, specifically a bottom pan 21 which is vertically spaced downwardly from but extends generally parallel with the horizontal rail 15. This member 21 is fixedly secured to lower ends of the leg parts 18 and, for this purpose, the lower ends of the side members 19 define thereon a pair of generally horizontally oriented side flanges 22 (FIG. 3) which protrude sidewardly in opposite directions and which bear on the bottom pan 21.

The pan 21 has upwardly protruding side flanges 23 which extend upwardly adjacent opposite sides of the bottom wall and protrude lengthwise therealong, whereby the bottom pan 21 has a generally cup-shaped upwardly-opening configuration, and has a width which generally corresponds to the width of the frame uprights 16 and associated cover tiles 12. The bottom pan side flanges 23, at the upper lengthwise-extending extremities thereof, are provided with upper edge parts 24 which are initially bent inwardly and then upwardly so as to define a slotted shoulder or step on which a lower horizontally extending edge of a removable side cover or tile 12 can be positioned.

The lower end part 18 of each frame upright 16 also has, as illustrated in FIG. 3, a leg support bracket 26 fixed thereto, such as to an inner surface of the lower part 18. This leg support bracket accommodates therein a vertically elongated threaded shaft 27 which can be rotatably threadably moved relative to the bracket so as to adjust the elevation of the threaded shaft, which threaded shaft at its lower end mounts a support foot or glide 28 which provides a cooperative supportive engagement with a floor. When the selected wall panels have been joined serially in a desired orientation, such as in aligned or transverse orientation, then a side cover pad can be attached to the frames in a desired and generally conventional manner, such being diagrammatically depicted in FIG. 1 which illustrates one of the cover pads in a partially detached condition.

Figure 4:
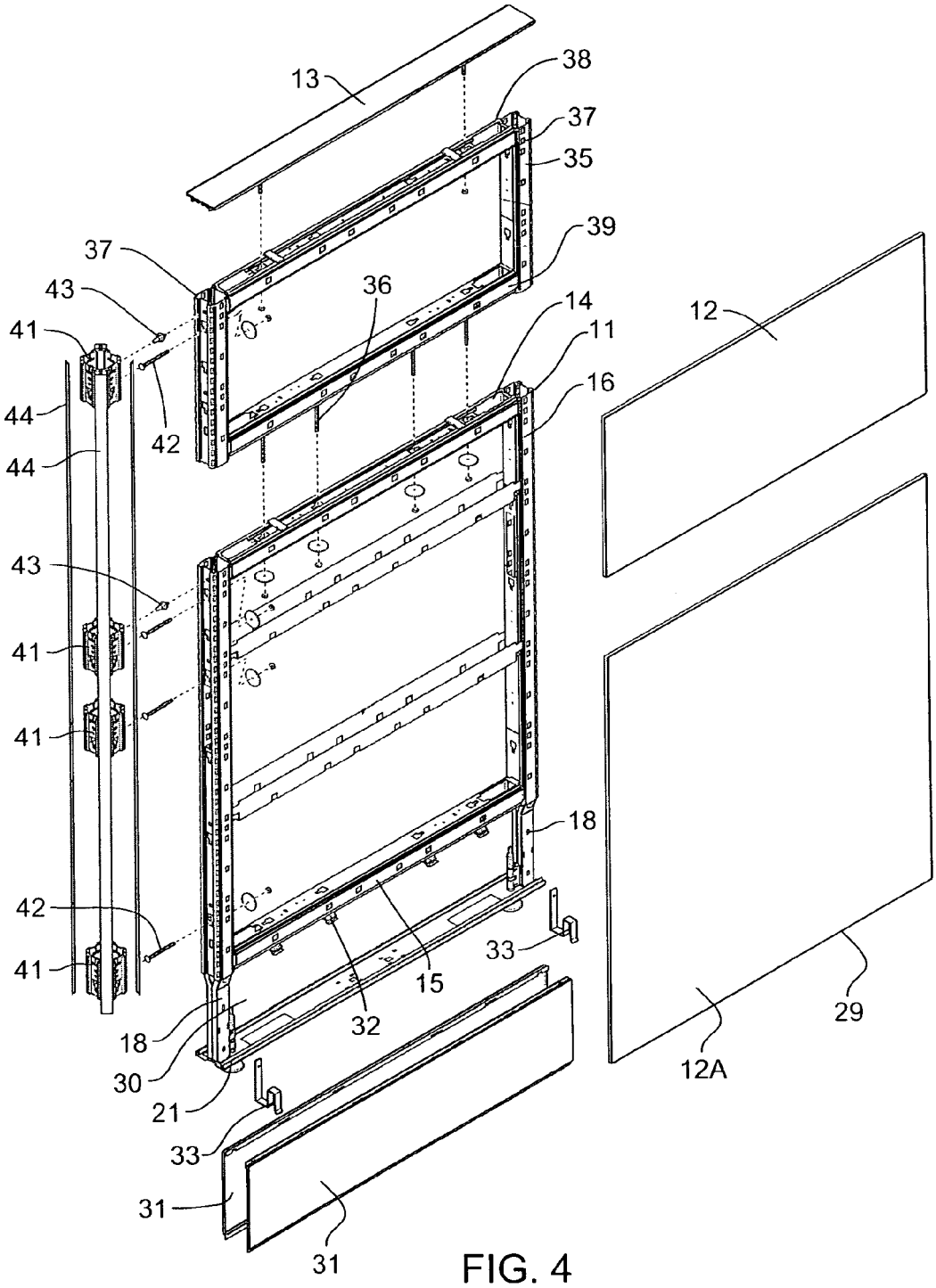
FIG. 4 is an exploded perspective view of a base panel frame, stack-on frame, and associated trim covers, as well as basic components of a corner connector arrangement.

Referring to FIG. 4, a further exploded view of the wall panel components is provided which further includes a base frame 11, a cover tile 12 and a larger-height cover tile 12A which is adapted to mount to the frame in a position wherein the bottom edge 29 thereof is disposed at floor height closely adjacent to the bottom pan 21 so as to enclose the raceway 30. Alternatively, the cover tile 12A may be replaced with a shorter height cover tile such as cover tile 12 which would leave open the raceway 30, which raceway 22 would then be enclosed on opposite sides by raceway covers 31 which would interconnect with the bottom pan 21 and appropriate connectors 32 located on the bottom of the bottom frame rail 15. The raceway 30 would then be accessible and adapted to support appropriate power or telecommunication data cables therein, which cabling may be supported on appropriate cable brackets 33 which mount to the face of the lower leg part 18.

Additionally an extension panel 35 may be provided that has a rectangular shape and is readily mountable to the top frame rail 14 through appropriate carriage bolts 36 as will be described in further detail hereinafter. Generally, the extension panel frame 35 comprises two short vertical upright rails 37 which are formed substantially the same as but shorter than the vertical frame rails 16. Additionally, the extension panel 35 includes top and bottom horizontal frame rails 38 and 39 respectively which join to the vertical frame rails 37 in an identical manner to the joining of the frame rails 14, 15 and 16 of the base frame 11. When the extension panel frame 35 is mounted to the base panel frame 11, the top cap 13 then would mount to the top frame rail 38 rather than the frame rail 14.

Additionally, to define multi-way corner connections such as a two-way, three-way or four-way connections, the wall panel system further includes an arrangement of connector blocks 41 which are each formed identical to each other and are individually mountable to either of the vertical frame rails 16 or 37 described above, which connection is accomplished through carriage bolts 42. Preferably, alignment pins 43 are provided which mate between the corner blocks 41 and the associate frame rail 16 or 37 to maintain proper vertical alignment thereof. For such multi-way connections, vertically elongate corner light blocks 44 are provided as will be described in further detail hereinafter.

Figure 5:
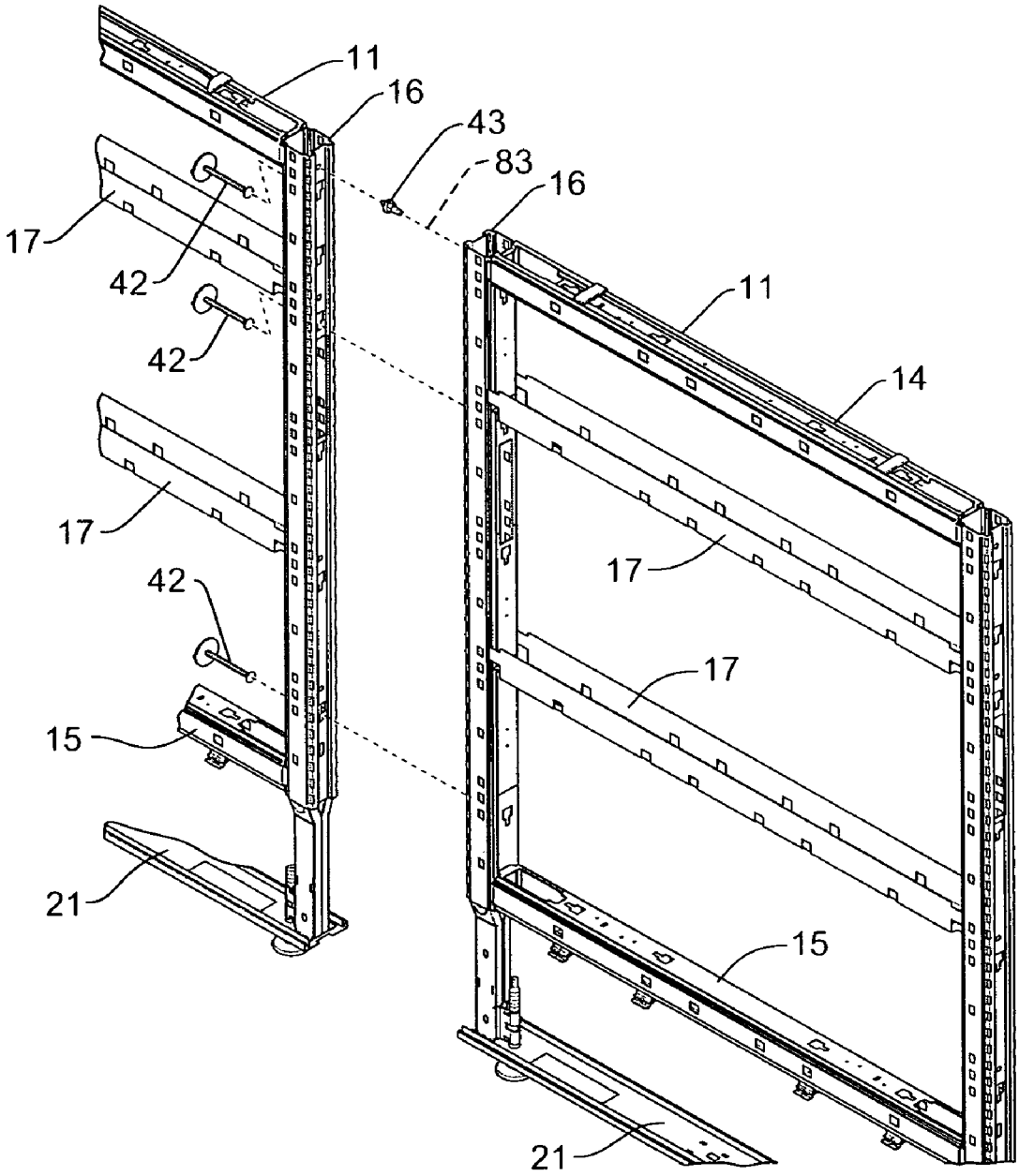
FIG. 5 is an exploded perspective view showing two panel frames being serially-connected together.
Figure 13:
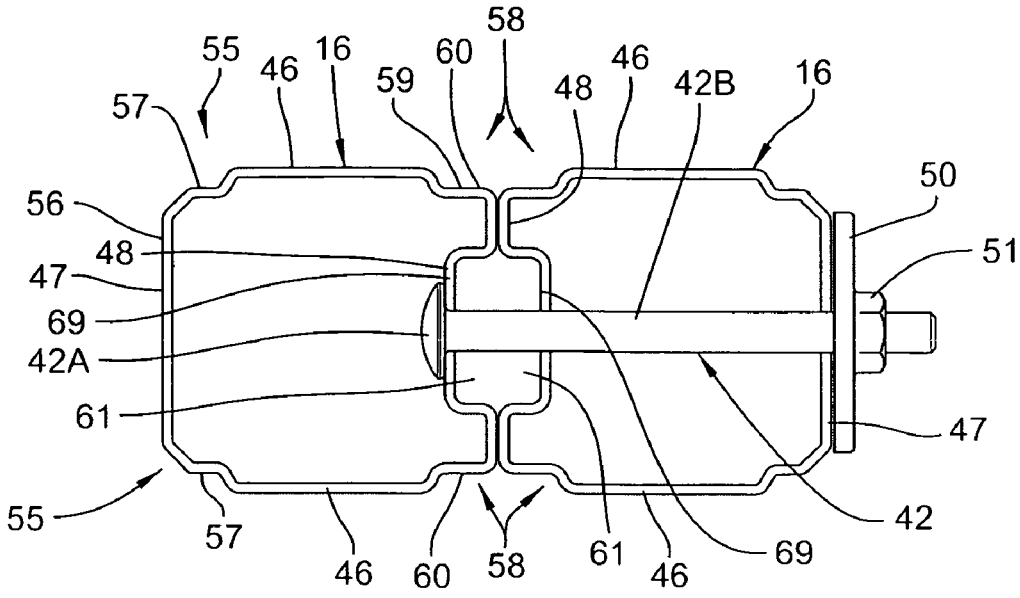
FIG. 13 is a plan view of the bolt connection between serially-adjacent panel frames.
Figure 14:
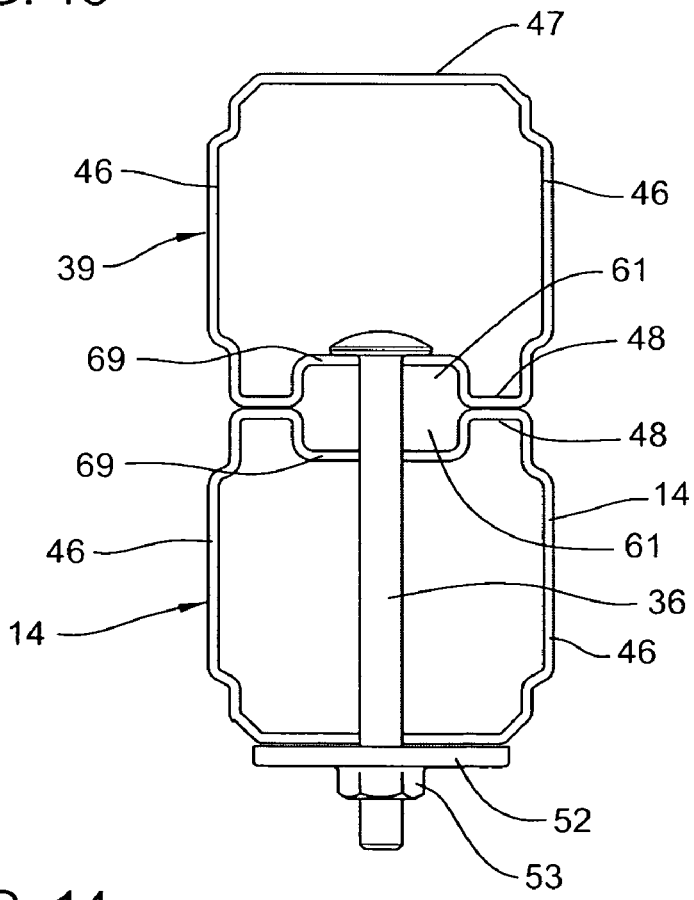
FIG. 14 is an end view of the bolt connection between vertically-adjacent panel frames.

The wall panel 10 of the invention and specifically the frame 11 thereof has an improved frame construction as defined by the frame rails 14, 15 and 16 which are each formed with the same or common cross-sectional profile. Referring to this profile as illustrated in FIG. 13, this profile is defined by side walls 46, interior wall 47 and outer wall 48. The side walls 46 are generally planar and extend substantially across the width of the frame rail 14, 15 or 16. FIGS. 5 and 13 illustrate the interconnection of two serially adjacent vertical frame rails 16 by the carriage bolt 42 which further comprises a washer 50 and nut 51. FIG. 14 similarly illustrates the top cross rail 14 of the bottom frame 11 being interconnected and joined together with the bottom cross rail 39 of the extension frame 35. These frame rails 14 and 39 are joined together by the aforementioned carriage bolt 36 which further includes a respective washer 52 and nut 53 and is the same as bolt 42. While these frame rails are designated by reference numerals 14, 15, 16, 38 and 39, it is noted that all of these frame rails have the same cross-sectional profile and as such, common reference numerals 46, 47 and 48 are used to designate the respective side walls, inner wall and outer wall thereof. While the frame rails 14, 16 and 39 as well as additional rails 38 and 15 have different specific constructions between the vertical rails versus the horizontal rails, these common cross-sectional profiles allow for a simplified manufacturing process with the primary difference being in the formation of rail-specific apertures which would initially be stamped into the material before roll forming is performed to form the tubular shape illustrated in FIGS. 13 and 14.

The following discussion primarily focuses on one of these frame rails with the common reference numerals being applied to the remaining frame rails. More particularly, FIG. 13 illustrates the leftward frame rail 16 as being stepped in the region of the inner corners 55 to define a narrowed interior section 56 which terminates at corner flats or faces 57. Additionally, the outer corners 58 also define a narrow outer portion 59 defined by outer corner flats or faces 60. A central recess or channel 61 which extends longitudinally along the length of the frame rail and opens up outwardly therefrom is seen in FIGS. 13 and 14. The cooperation of these various formations with each other in the construction of the frame will be discussed in further detail hereinafter.

Figure 6:
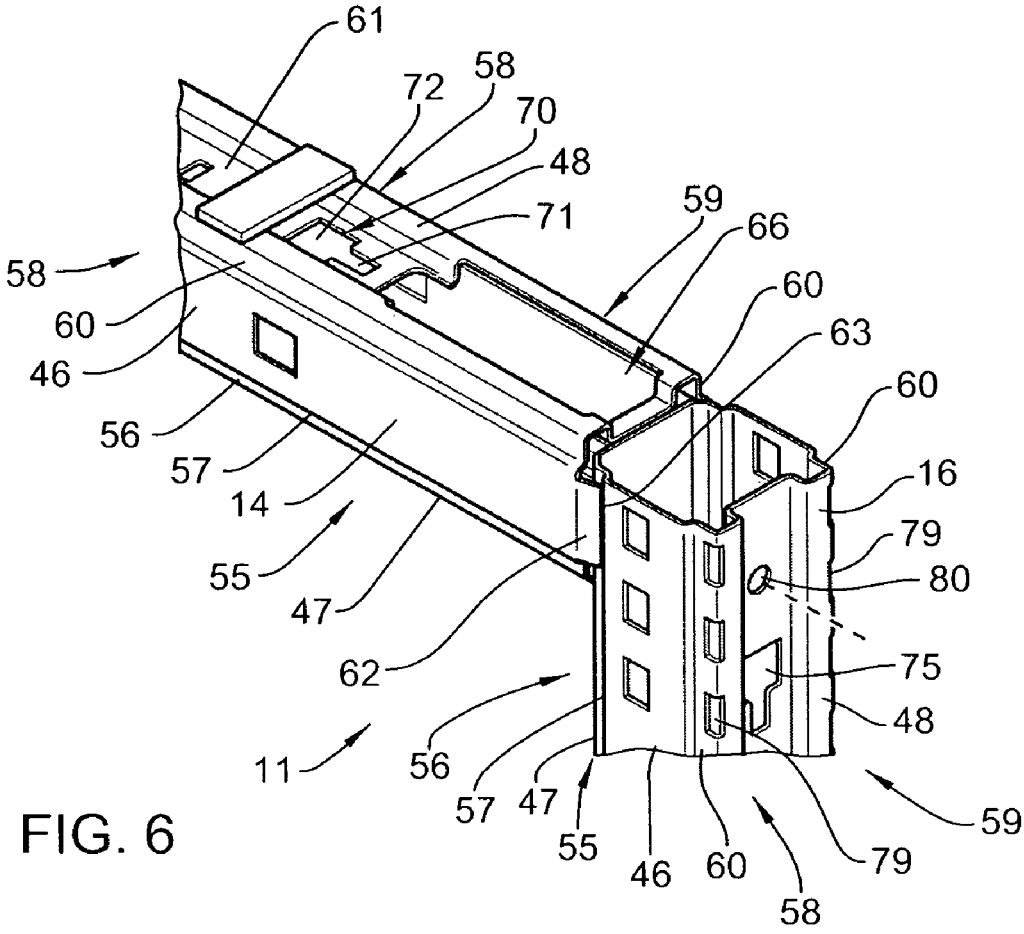
FIG. 6 is an enlarged fragmentary perspective view illustrating a corner connection between a horizontal frame rail and vertical frame rail in a first configuration.

More particularly as to FIG. 6, FIG. 6 illustrates a first configuration of the horizontal frame rail 14 being interconnected to the upper end of the vertical frame rail 16 to define an upper corner of the panel frame 11.

To join the horizontal frame rail 14 or even rail 15 to the vertical rail 16, each of the side walls 46 of the frame rail 14 as well as the frame rail of 15 is formed with a welding flange 62 projecting sidewardly therefrom such that each opposite end of a horizontal frame rail 14, 15, 38 or 39 is provided with a pair of spaced apart, parallel weld flanges 62 which fit over and straddle the narrowed interior portion 56 of the respective vertical frame rail 16 or 37. Specifically as to FIG. 6, these weld flanges 62 abut against the corner flats 57 of the narrowed interior portion 56 and then are welded thereto along the terminal edge 63 of the weld flange 62. As such, these weld flanges 62 properly align the horizontal rail with the vertical rail 16 prior to welding and automatically position the weld flange 62 in an appropriate position against the opposing corner flat 57 to which the weld flanges 62 are secured. The structural configuration illustrated in FIG. 6 as well as various additional drawings herein which correspond to this first variation provides an improved arrangement to facilitate welding of the vertical and horizontal frame rails.

Figure 7:
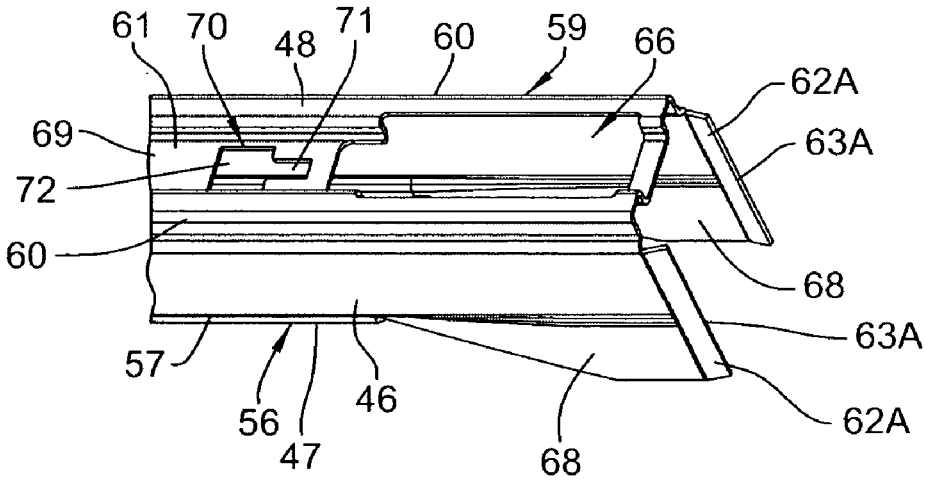
FIG. 7 is a partial perspective view of one end of a horizontal frame rail in a preferred, second configuration.
Figure 8:
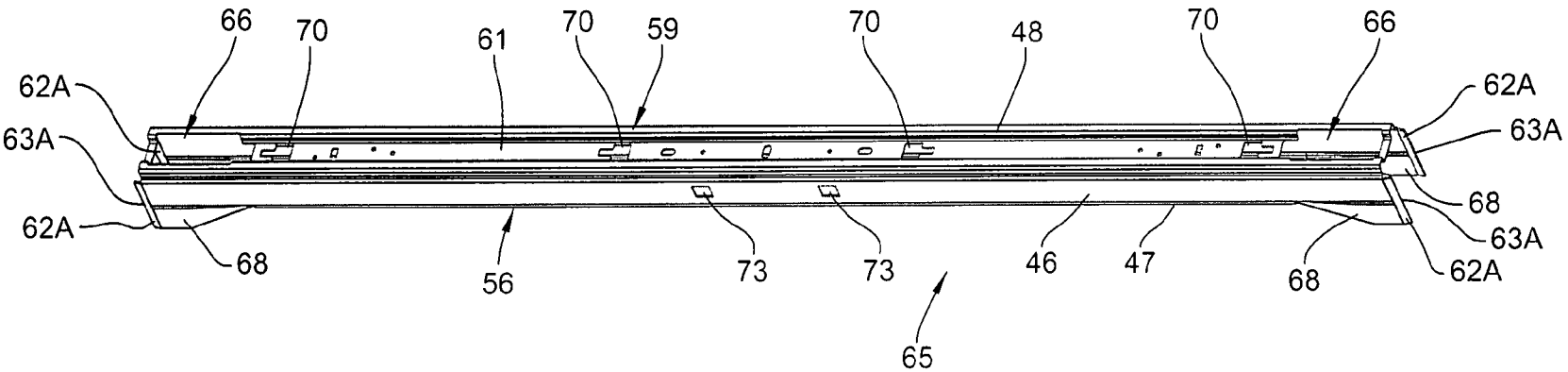
FIG. 8 is a front perspective view of the horizontal frame rail of FIG. 7.

Referring to FIGS. 7 and 8, an improved and preferred second configuration for the horizontal frame rails 14, 15, 38 and 39 is illustrated which provides the same benefit of the weld flange 62 above but also provides for additional strength through the integral formation of gussets within these frame rails.

More particularly, the horizontal frame rail 65 is illustrated and it will be understood that this frame rail 65 may be used in place of any of the frame rails, 14, 15, 38 or 39 referenced above without requiring any changes in the vertical frame rails 16 or 37.

As to the frame rail 65, it is similarly formed with the same cross-sectional profile illustrated in FIGS. 13 and 14 such that the frame rail 65 further includes the various rail formations 46-48 and 55-61. Further, weld flanges similar to weld flange 62 referenced above are also provided and these have an improved configuration.

Figure 9:
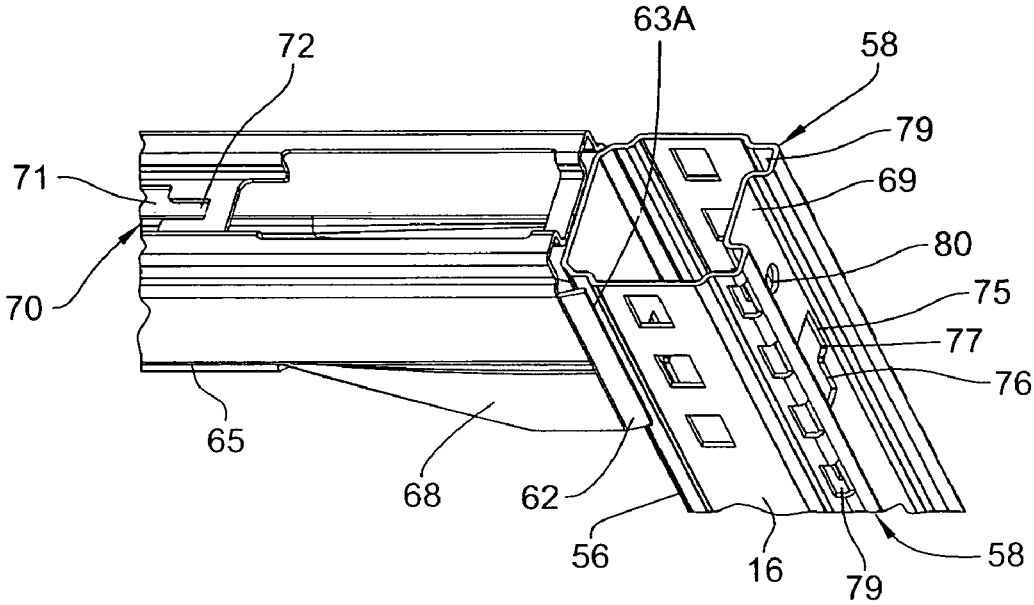
FIG. 9 is an enlarged fragmentary perspective view illustrating a corner connection between a horizontal frame rail and vertical frame rail in the second configuration.
Figure 10:
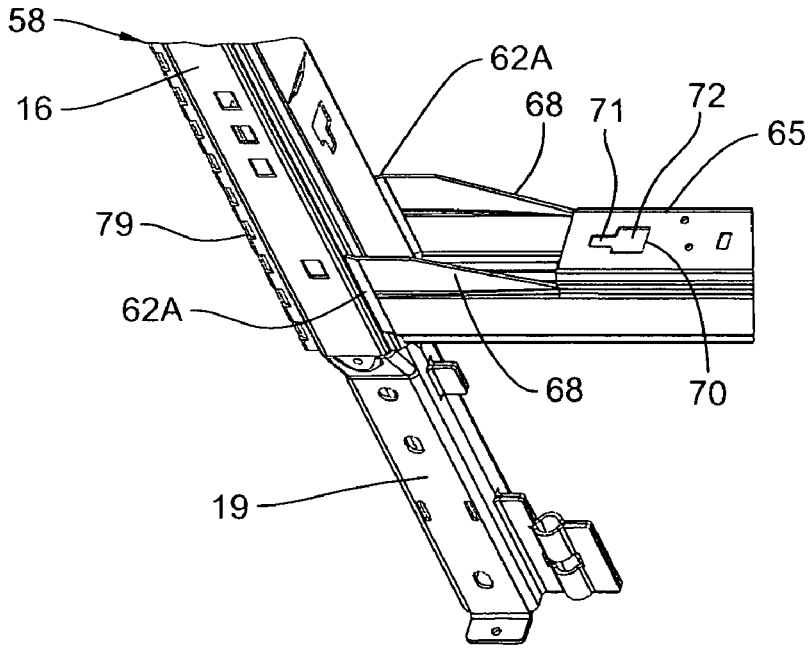
FIG. 10 is an enlarged partial perspective view of a bottom frame rail connected to the vertical frame rail.

In particular, it is noted that each frame rail 65 as well as the above frame rails include appropriate passages 66 in the respective outer and inner walls 48 and 47 near the opposite ends of the frame rail. As to the interior side of this passage 66 through the inner wall 47, the material from this inner wall 47 is maintained on the frame rail and formed as a planar, inwardly extending reinforcement flange 68. These reinforcement flanges 68 are formed flush with the side walls 46 and as an integral extension thereof, and preferably have a generally triangular shape as illustrated in FIGS. 7 and 8. The outer edges of each side wall 46 and associated reinforcement flange 68 are formed with weld flanges 62A which project sidewardly from the ends of the reinforcement flanges 68 and function similar to the above-described weld flanges 62. These weld flanges 62A as seen in FIG. 9 similarly are shaped so as to straddle the narrowed interior portion 56 of the associated vertical frame rail 16 wherein the terminal edge 63A thereof is welded along its length to the narrowed interior rail portion 56. This terminal flange edge 63A has a greater vertical length than the above-described terminal flange edge 63 and as such provides a greater weld length and greater associated strength which is further reinforced by the reinforcement flanges 68 that essentially serve as corner gussets in the frame 11 or the frame 35 mentioned above. FIG. 9 illustrates the frame rail 65 in the top position of frame rail 14 as being connected to the upper end of the frame rail 16 to define the upper corner of the frame 11. FIG. 10 similarly illustrates the frame rail 65 in an inverted orientation in the position of frame rail 15 with the weld flanges 62A thereof welded to the lower end of the vertical frame rail 16. The reinforcement flanges 68 therefore serve as gussets in the upper and lower corners of the rectangular frame. It will be understood that these frame rails 65 are interchangeable with any of the horizontal frame rails described above and thus, the following discussion as addressed to these frame rails 14, 15, 16, 38 and 39 is readily applicable to the frame rail 65, which frame rail 65 is preferred due to the additional strength and rigidity provided by the increased vertical length of the weld flanges 62A and the integral gusset 68 defined thereby.

It is noted that the various frame rails, whether horizontal or vertical have the same cross-sectional profile as each other. However, the horizontal frame rails are formed with different patterns of openings therein. In this regard and referring to FIGS. 6-10, the horizontal frame rails already have been described as including the passages 66 extending vertically therethrough which passages are illustrated in the second rail configuration of FIG. 8 or the first rail configuration of FIG. 6. Due to the common patterns of openings in these frame rails, common reference numerals are used for these openings. More particularly, the horizontal frame rails further include horizontally spaced apart T-shaped openings 70 which are defined by a narrow portion 71 and a wide portion 72. As will be better understood from the following discussion, the wide portion 72 is adapted to receive the head 36A of the carriage bolt 36 therethrough, while the narrow portion 71 accommodates the shank 36B of the bolt 36 wherein assembly is performed by first inserting the head through the wide portion 72 and then shifting the carriage bolt sidewardly into the narrow portion 71, after which the associated nut 53 is tightened in place.

The side rail walls 46 also include rectangular openings 73 which are provided to support the cover tile 12 thereon. Further discussion of this feature is not required.

Next as to the vertical frame rails 16, these frame rails 16 also are formed similar to each other in that they include their own respective patterns of openings therein.

Figure 11:
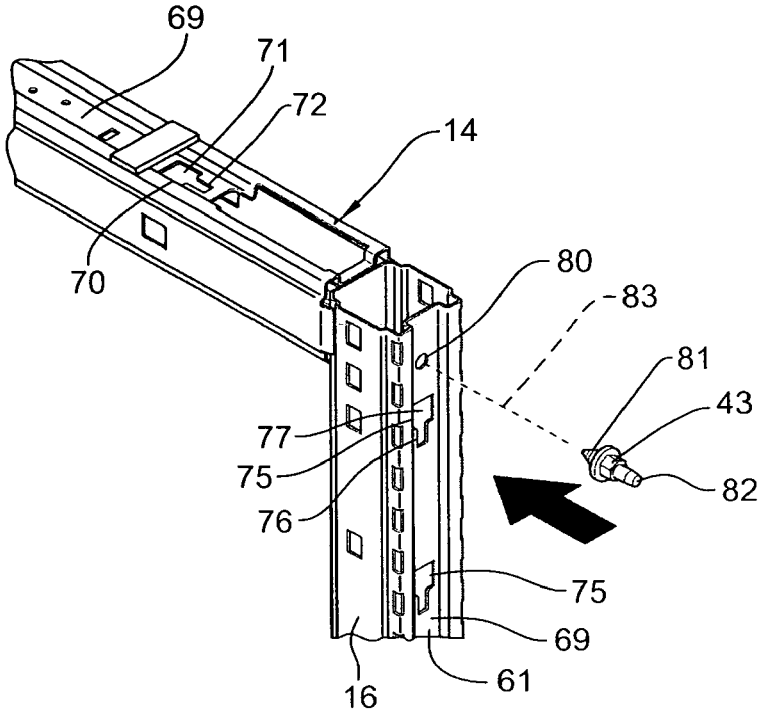
FIG. 11 is an exploded perspective view of an alignment pin arrangement for the panel frame.
Figure 12:
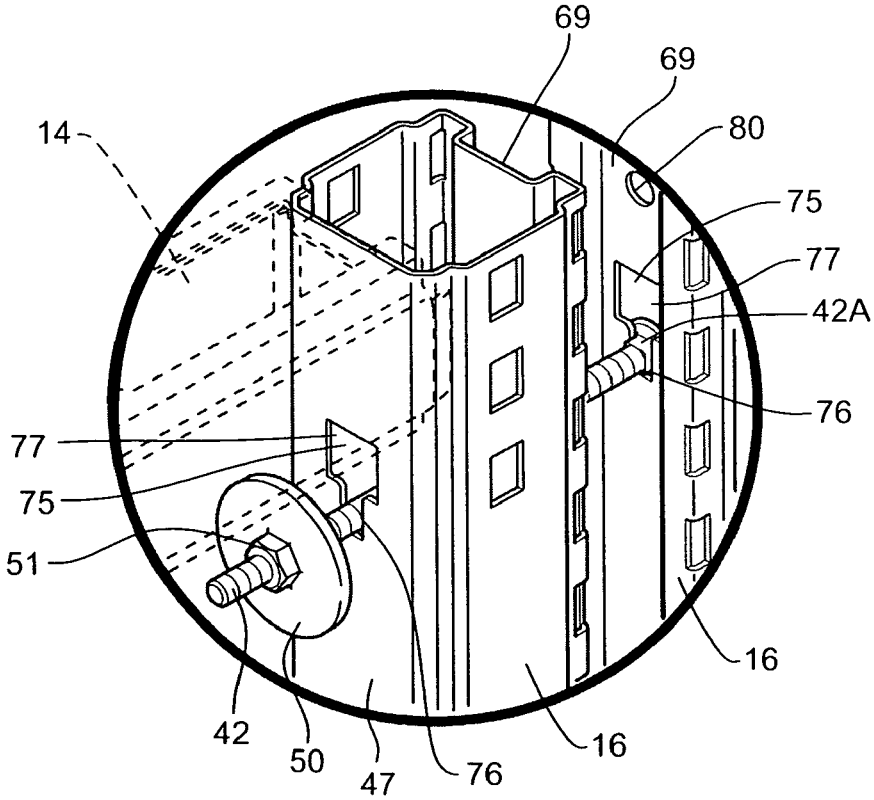
FIG. 12 is an enlarged fragmentary perspective view showing a bolt connection between serially-adjacent panel frames.

In particular, as seen in FIGS. 9 and 11-12, the vertical frame rails 16 include vertically spaced-apart T-openings 75 in each of the inner wall 47 and the bottom wall 69 of the channel 61, which T-openings 75 in the inner wall 47 and bottom wall channel 69 are horizontally aligned with each other in associated pairs of such T-openings 75. Each T-opening 75 is similarly formed with a narrow portion 76 and wide portion 77 to thereby accommodate the head 42A of a carriage bolt 42 in the wide portion 77 and allow for sliding of the bolt shank 42B into the narrow portion 76 for securement of two adjacent wall panel frames together as seen in FIGS. 12 and 13. As best seen in these figures, the carriage bolt 42 has a length which extends through the entire thickness of one frame rail 16 and only partially into and through a single one of the rail walls, namely outer rail wall 48 of the serially adjacent frame rail 16. As such, the head 42A seats in the narrow portion 76 of one frame rail 16 and abuts against the slot wall 69 wherein the rectangular portion of the carriage bolt head 42A is prevented from rotating in the narrow slot portion 76 (FIG. 12). The shank 42B of the lag bolt then passes through the aligned T-shaped opening 75 of the other frame rail 16 and the innermost T-opening 75 formed in the inner wall 47 thereof. Assembly is accomplished by sliding the bolt head 42A horizontally through the aligned wide portion 77 of the aligned T-opening 75 and then slipping the bolt shank 42B downwardly into the narrow portion 76, after which the washer 50 is placed in position and the nut 51 tightened to rigidly join the serially adjacent frame rails 16 together. In a similar manner, the horizontal frame rails 14 and 39 (FIG. 14) also are secured together with the carriage bolts 36.

In addition to the T-openings 75 discussed above, additional aperture formations are provided in the vertical rails. In particular, outer corners 58 also are provided with vertical rows of slots 79 which are used in a conventional manner for the mounting of accessory brackets, such as overhead storage units and the like. Still further, additional holes 80 are provided in vertically spaced relation which holes 80 are adapted to receive the aforementioned alignment pins 43 as generally illustrated in FIG. 11. Each alignment pin 43 includes a threaded engagement section 81 which is fixedly secured in associated hole 80, as well as a projecting pin portion 82 which projects outwardly therefrom and is adapted to align with the corresponding hole 80 in an adjacent frame rail 16 as indicated by dotted line 83 in FIGS. 5 and 11. By inserting the various pin portions 82 of the alignment pins 43 in an adjacent frame rail, these serially adjacent frame rails 16 may initially be aligned with each other before engagement of the carriage bolts 42 described above.

Turning next to FIGS. 15-18, multi-way corner connections are defined through the use of the corner blocks 41 previously illustrated in FIG. 4. These corner blocks 41 are tubular metal extrusions, preferably formed from extruded aluminum and are configured to join selectively to multiple panel frames 11 and specifically to the vertical frame rails 16 or 37 thereof. As to FIG. 15, a full-height panel frame 11 is illustrated being joined to shorter-height panel frames 11A through the use of two corner blocks 41 disposed between these three panel frames. It is noted that additional upper corner blocks 41 are mounted to the upper end of the panel frame 11 above the upper edge of the shorter frames 11A which upper corner blocks 41 provide for the mounting of additional wall panels thereto. The lower corner blocks 41 join serially between two adjacent panel frames 11A and the full-height frame 11 to define a three-way corner connection.

Figure 16:
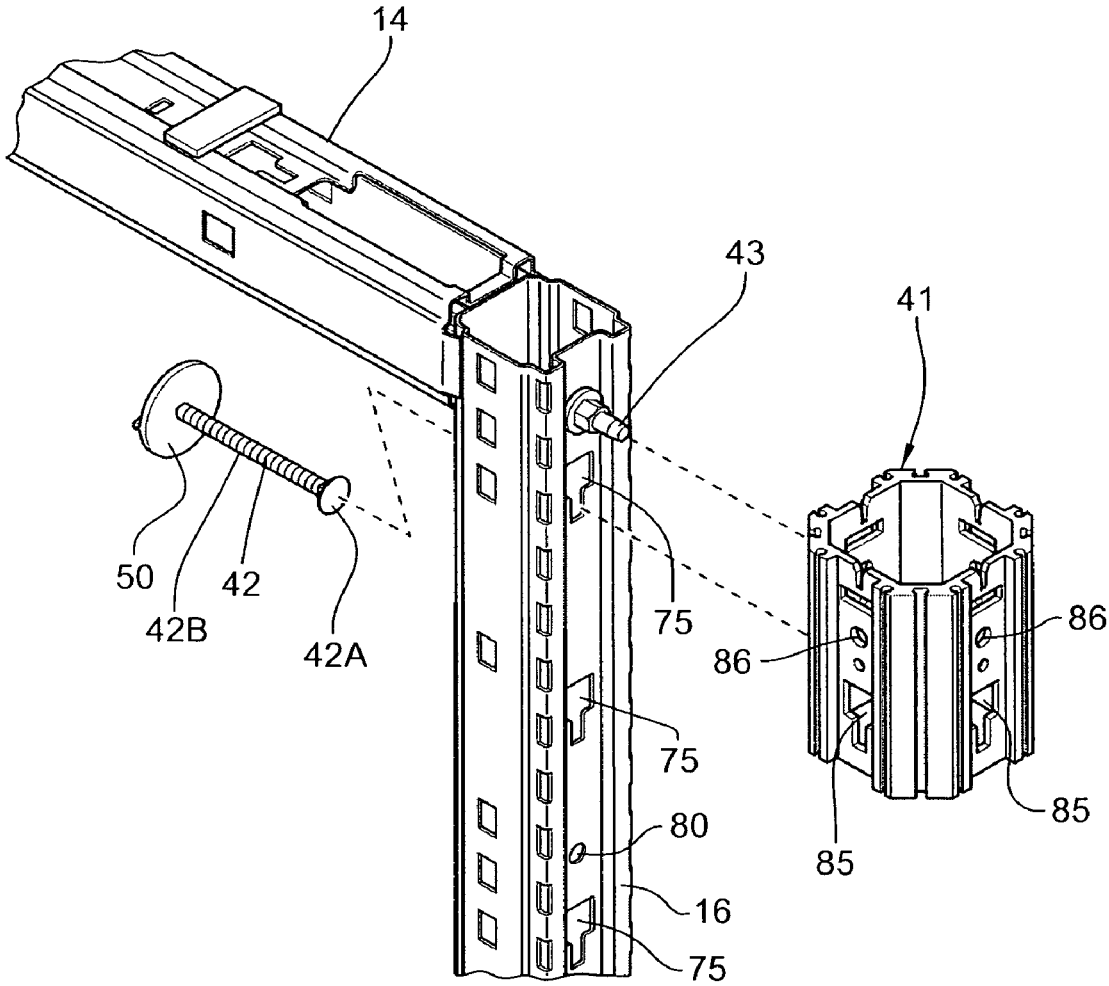
FIG. 16 is an exploded fragmentary perspective view of the bolt connection between a panel frame and a corner block.
Figure 17:
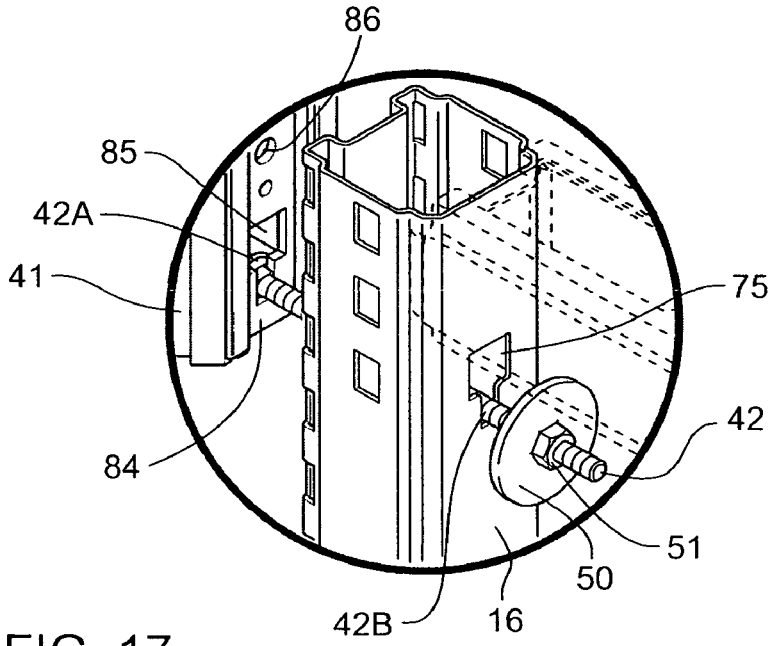
FIG. 17 is an enlarged view of the bolt connection between the panel frame and corner block.
Figure 18:
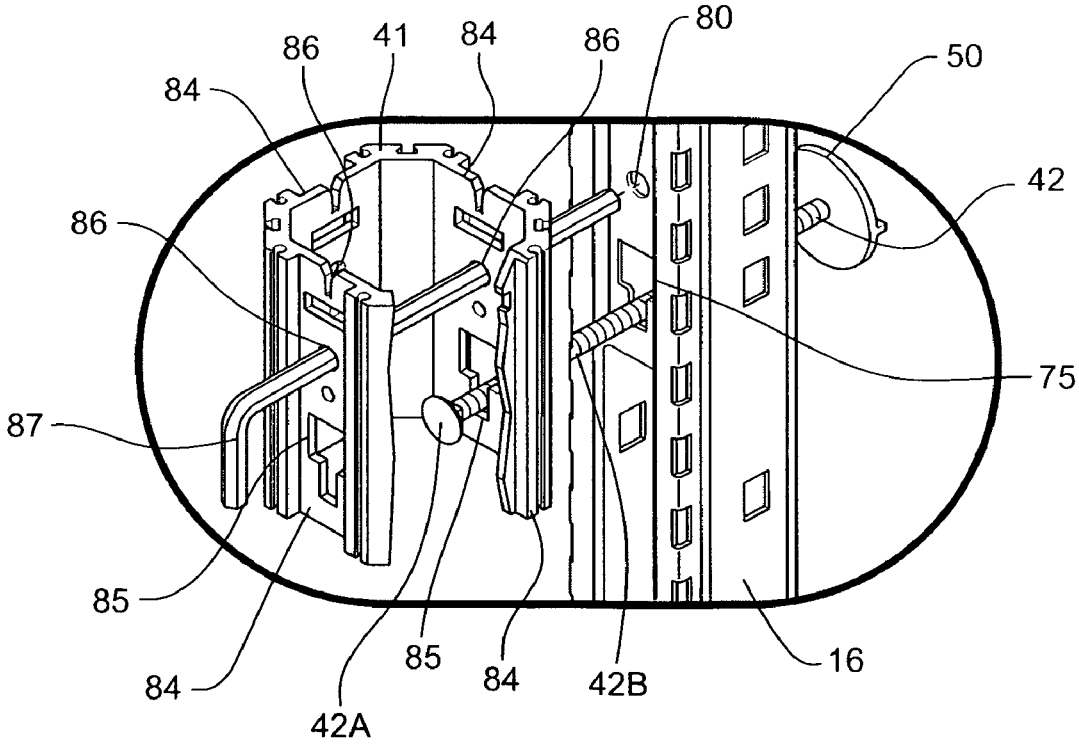
FIG. 18 is an enlarged fragmentary perspective view illustrating the alignment process for mounting an intermediate corner block to a panel frame.

As generally seen in FIGS. 16 and 18, the corner blocks 41 each include four block walls 84 which extend vertically in a rectangular cross-sectional profile as viewed from above. Each of the block walls 84 includes a pattern of openings formed therein which each comprise a T-opening 85 which is structurally and functionally the same as the T-openings 70 and 75 described above. More particularly, the T-openings 85 are configured for horizontal alignment with the T-openings 75 formed in the vertical frame rails 16. As seen in FIGS. 17 and 18, the head 42A of the bolt 42 engages one block side wall 84 with the shank 42B being extended through the frame rail 16 and the washer 50 and nut 51 being fitted onto the end of the shank 42B and tightened so as to secure the corner block 41 to the vertical frame rail 16.

Typically the corner block 41 is positioned on one of the frame rails 16 and then the other wall panel frames 11 or 11A are positioned adjacent thereto and then attached by suitable bolts 42.

Figure 15:
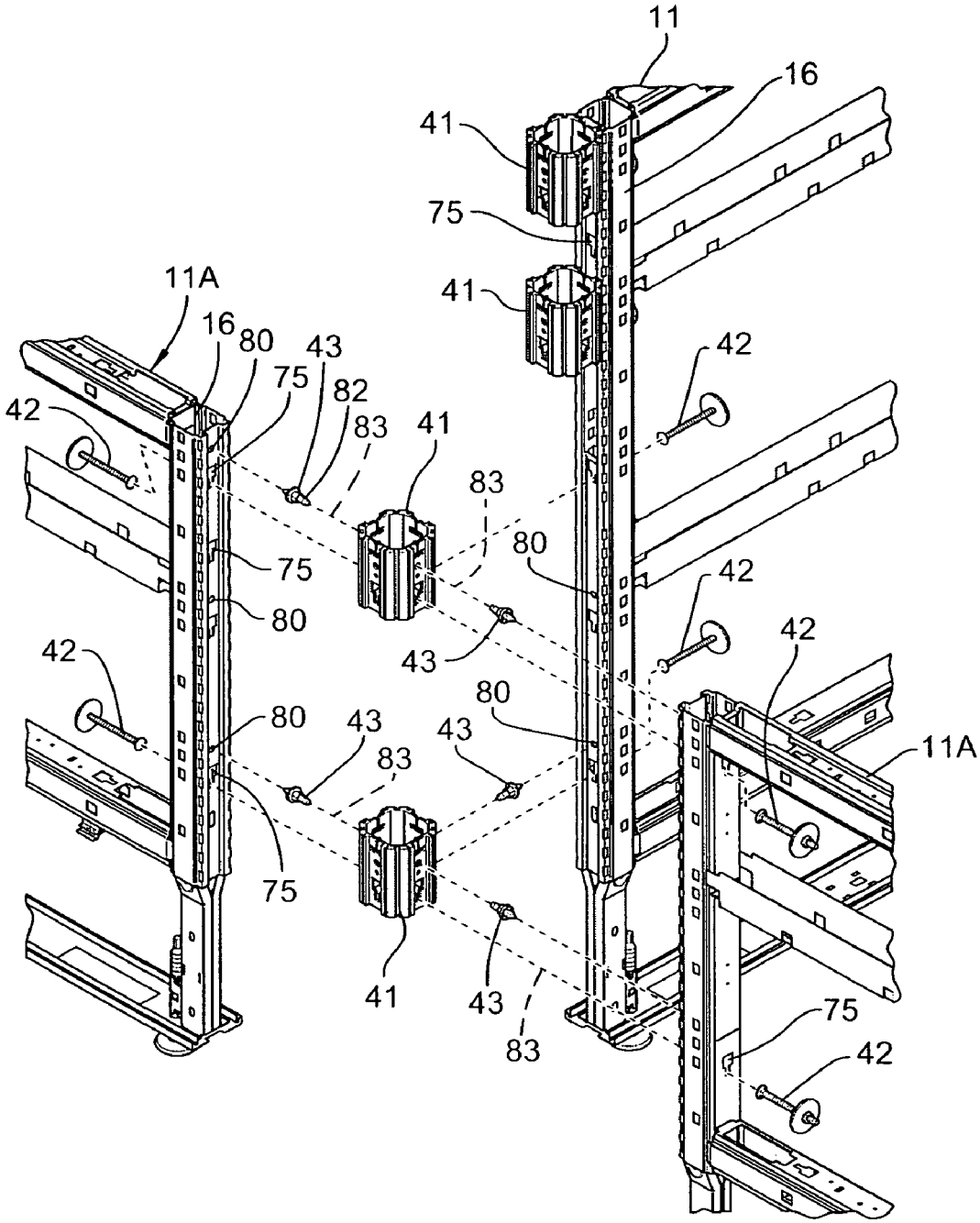
FIG. 15 is an exploded fragmentary perspective view of a three-way connection between adjacent panel frames.

To ensure alignment of the corner block 41 on the frame rail 16, each block side wall 84 includes an alignment hole 86 which is adapted to receive the pin portion 82 of the alignment pin 43 as generally illustrated by phantom lines in FIG. 15. For those instances when mounting the first corner block 41 to a panel frame 16 where a pin 43 is not present, FIG. 18 illustrates an Allen wrench 87 being fitted horizontally through an aligned pair of the alignment holes 86 and then slid into a corresponding hole 80 formed in the frame rail 16 to align the components. This Allen wrench 87 could then be removed therefrom once the wall panel 11 or 11A is secured to the corner block 41.

Figure 19:
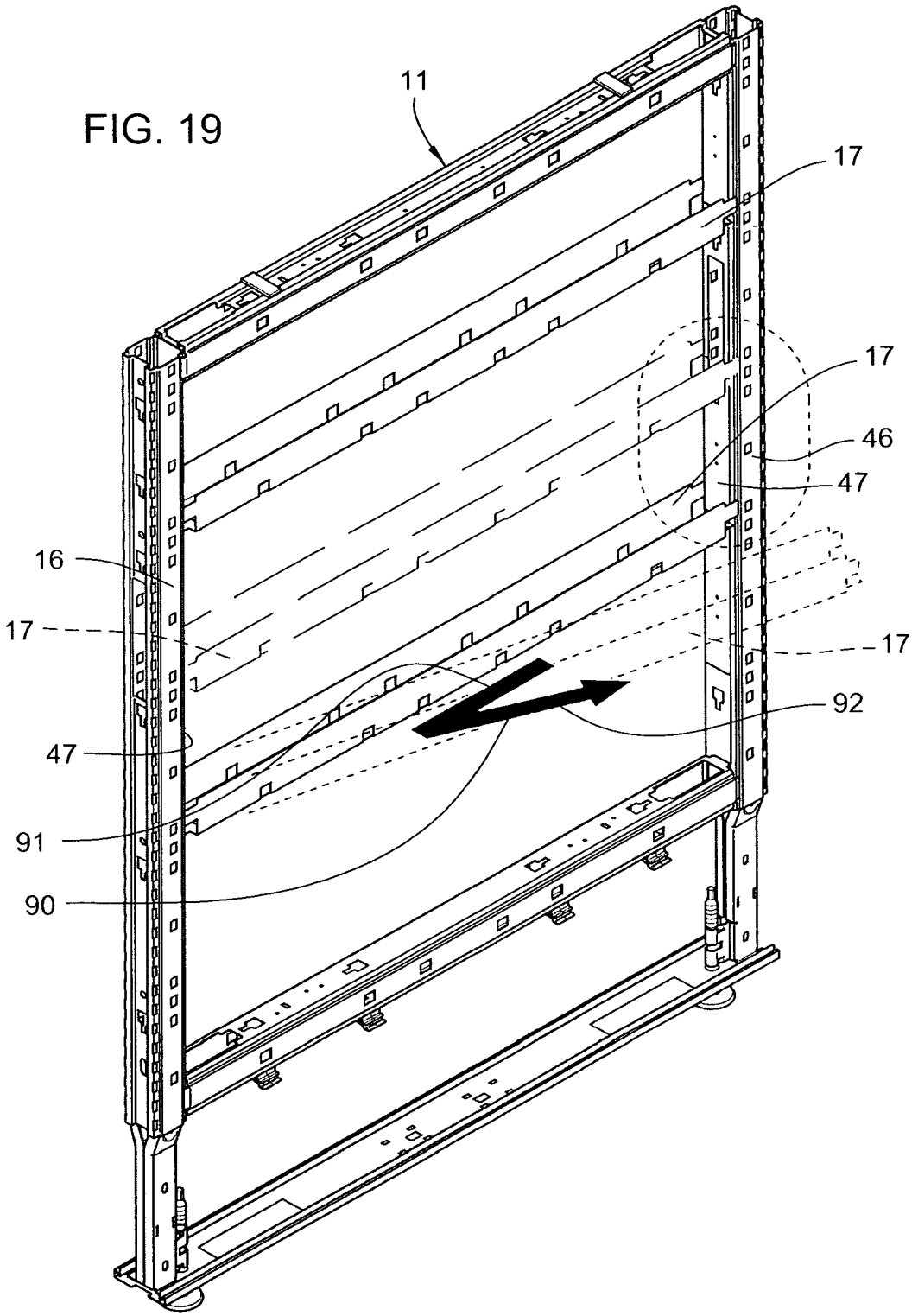
FIG. 19 is a perspective view of a panel frame and a light block rail being mounted thereto.
Figure 20:
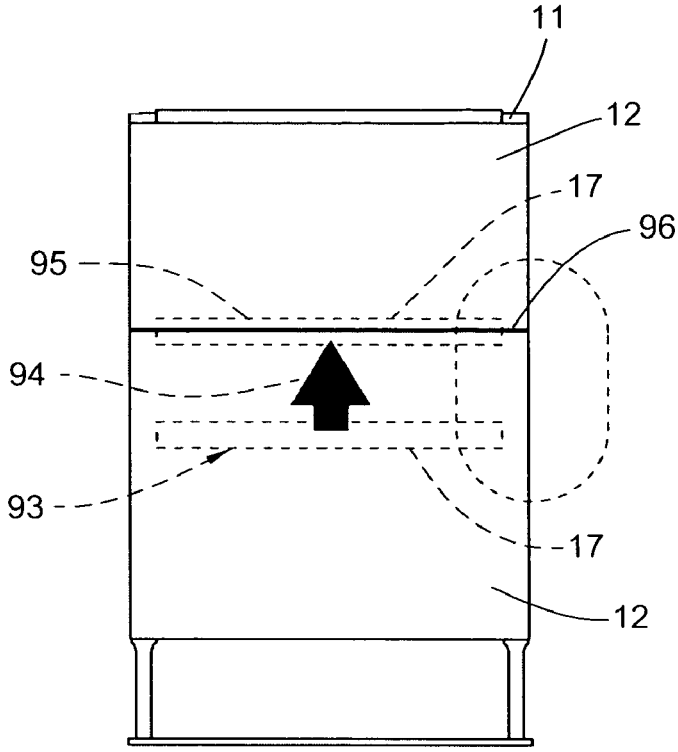
FIG. 20 is a front elevational view of a wall panel assembly with the light block rails illustrated in phantom outline in the alternate positions.
Figure 21:
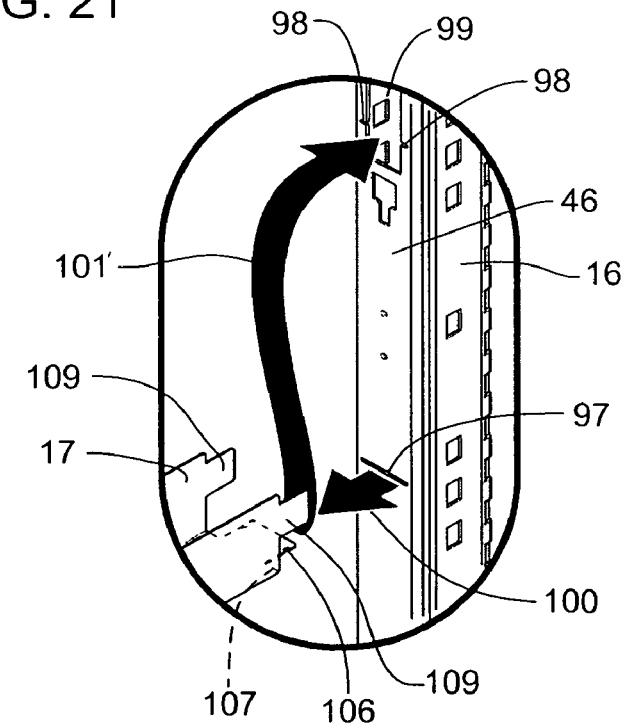
FIG. 21 is an enlarged fragmentary perspective view of a connection between a vertical frame rail and light block rail.

Referring to FIGS. 19-21, the panel frame 11 further is provided with the channel-like cross-rails 17 which assist in mounting of the cover tiles 12 thereto and also serve as light blocks by being positioned along the horizontal gap or joint between two vertically-adjacent cover tiles 12. As seen in FIG. 19, the cross-rails 17 may be positioned at a variety of vertical elevations as indicated in both solid outline and phantom outline. The individual cross-rail 17 is configured to span the lateral width between a spaced apart pair of frame rails 16 and essentially spans this distance while still being removable therefrom as indicated by reference arrow 90 in FIG. 19. Each cross-rail 17, in particular, is removable by first shifting the cross-rail sidewardly as indicated by arrow segment 91 which disengages the rightward end of the cross-rail 17 from the associated vertical frame rail 16 that then allows outward tilting of the cross-rail 17 as indicated by arrow segment 92.

As seen in FIG. 20, the cross-rails 17 are positionable at multiple locations including an intermediate position indicated by reference arrow 93 wherein the cross-rail 17 is positioned generally in the middle or intermediate portion of the lower cover tile 12. However, this cross-rail also may be positioned upwardly as indicated by reference arrow 94 to position 95 wherein the cross-rail 17 is positioned and extends horizontally along the horizontal gap or joint 96 defined between the two vertically adjacent cover tiles 12.

Referring to FIG. 21, the vertical frame rails 16 are provided with multiple mounting locations which are defined by either a continuous mounting slot 97 or a bifurcated slot defined by slot segments 98 which are disposed on opposite sides of a passage 99 that is formed in the vertical frame rail 16. Hence, the illustrated cross-rail 17 of FIG. 21 may be removed from slot 97 as indicated by reference arrow 100 and then shifted upwardly to the slot segments 98 as indicated by reference arrow 101 which is the general repositioning described above relative to FIG. 20.

Referring to FIGS. 22-24, the cross-rail 17 has a generally U-shaped channel configuration defined by a bottom wall 102 and upstanding side walls 103 which extend along the longitudinal length of the rail 17. These side walls 103 intermediately along the length thereof also include openings 104 which cooperate with the cover tiles 12 for mounting thereof. The opposite ends of the bottom wall 102 also include passages 105 which allow for the passage of cabling therethrough.

Figure 25:
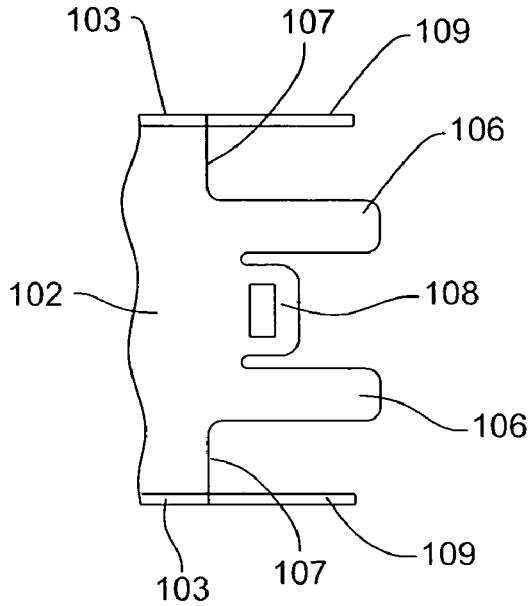
FIG. 25 is a partial plan view of the end of the light block rail.
Figure 26:
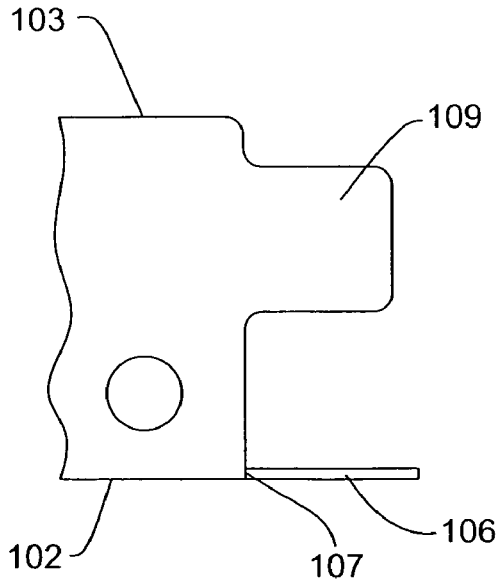
FIG. 26 is a partial front view thereof.

Referring to FIGS. 22, 23 and 25-26, the bottom channel wall 102 further includes support flanges 106 projecting longitudinally therefrom which support flanges 106 slidably fit into the associated support slots 97 or 98 in the vertical frame rail. These slots extend inwardly and, terminate at stops 107 which are adapted to abut against the inside face of the vertical frame rail 106 wherein the horizontal distance between the stops 107 on the opposite ends of the channel 17 have a horizontal spacing or dimension which is less than the horizontal distance between the opposing side walls 46 of the vertical frame rails 16. As such, during mounting of the cross-rails 17, the support flanges 106 at one end are inserted into one of the slots 97 or 98 until the stops 107 contact the inside rail wall 46. In this fully inserted position, the support flanges 106 are able to clear the corresponding inside rail wall 46 so that the cross-rail 17 can be swung inwardly opposite to the direction of reference arrow 92 in FIG. 19. This cross-rail 17 is now disposed between the frame rails 16 and then may be shifted sidewardly so as to now insert the free end of the cross-rail 17 into the corresponding slot 97 or 98 by inserting the support flanges 106 into this slot 97 or 98. After this horizontal shifting as indicated by the arrow segment 91 (FIG. 19) the cross-rail 17 is now supported on the support flanges 106 at the opposite ends thereof in a final, mounting position within the associated slot of the frame rail. To maintain the cross-rail 17 in this mounted position, a resilient lock tab 108 is disposed intermediate a pair of support flanges 106 as seen in FIG. 25 which stop tab 108 is also adapted to slide into a corresponding slot 97 or 98 with resistance which resistance then impedes unwanted horizontal shifting of the cross-rail 17. This resistance, however, may be overcome by manual shifting of this cross-rail 17 during the removal process.

Additionally, the channel side walls 103 also include alignment flanges 109 which are positioned to straddle or be disposed sidewardly of the vertical frame rail side walls 46 to further support the cross-rail 17 on the frame rail 16. With this arrangement, an improved light block is provided.

Figure 27:
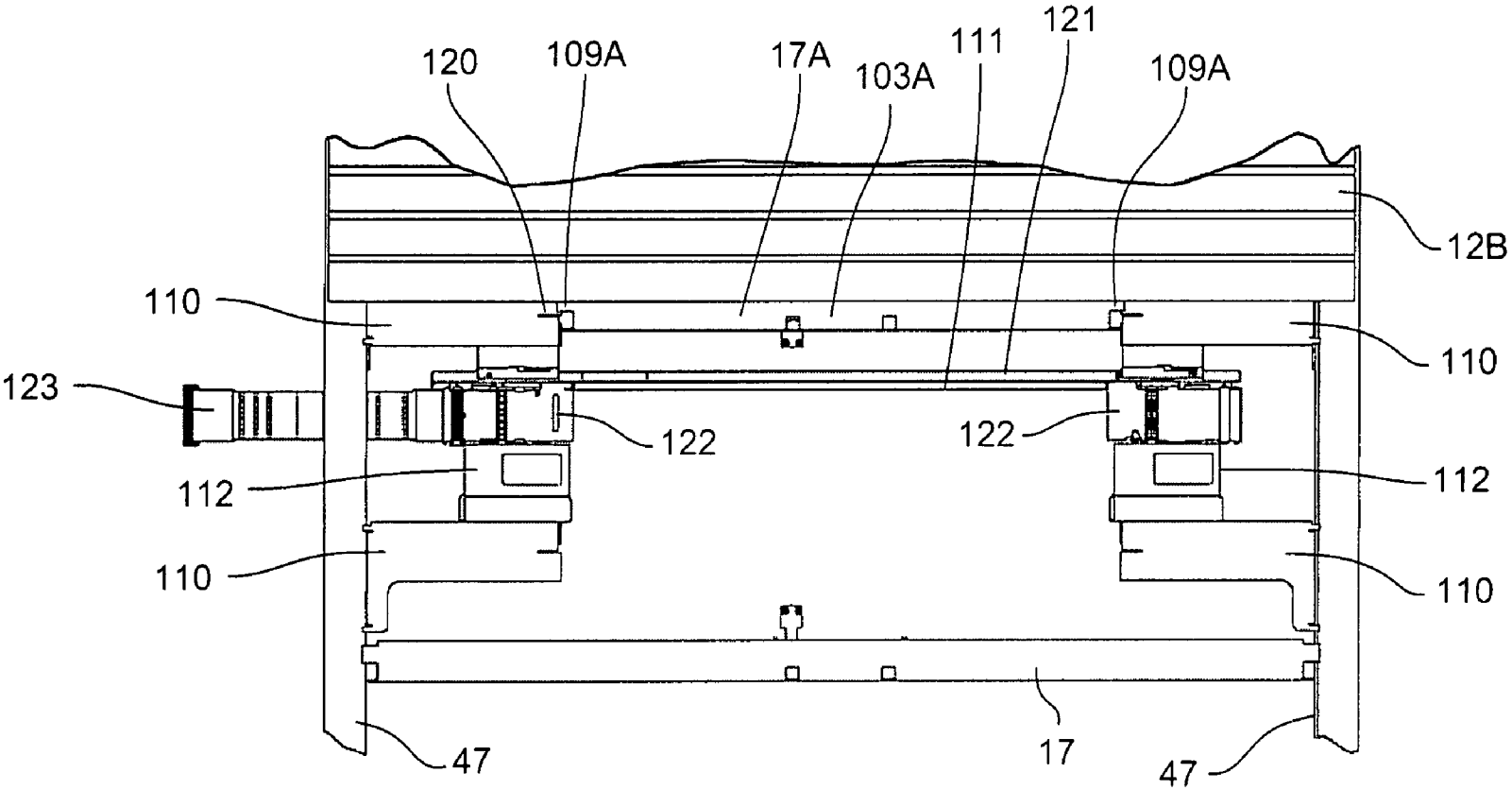
FIG. 27 is a partial front elevational view of a crossbar bracket arrangement for supporting power and data communication components within the panel frame.
Figure 28:
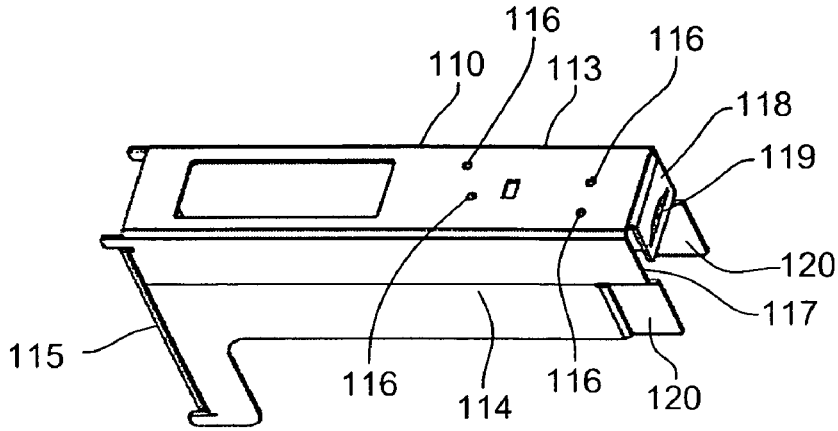
FIG. 28 is a perspective view of the mounting bracket for the crossbar arrangement.
Figure 29:
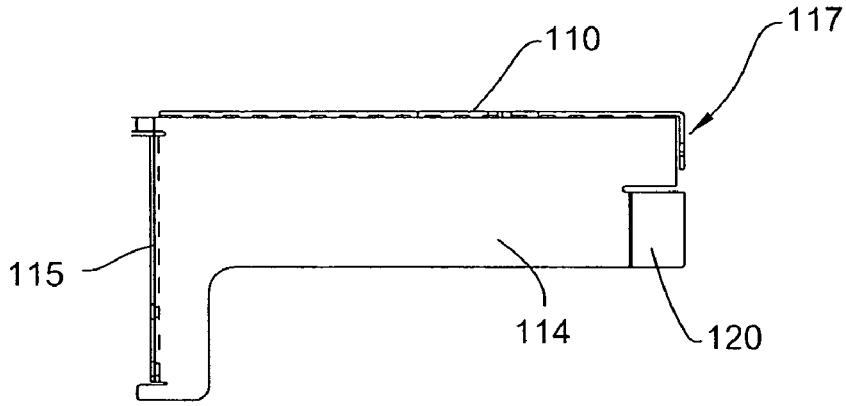
FIG. 29 is a front view thereof.
Figure 30:
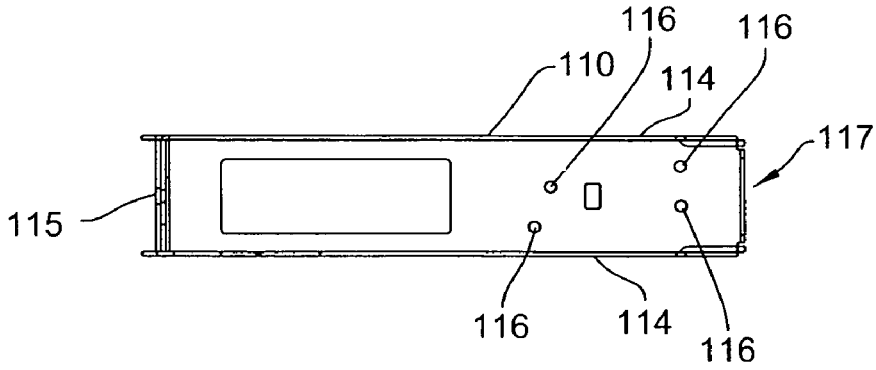
FIG. 30 is a plan view thereof.

Next as to FIGS. 27-30, a shortened form of this cross-rail 17A is illustrated which is usable with mounting brackets 110 for supporting a power distribution assembly 111 thereon or telecommunications receptacle units 112 and further serving as a light block for a cover tile joint such as along slotted cover tile 12B. More particularly, the mounting bracket 110 has a top wall 113 which turns downwardly into generally L-shaped side walls 114. The largest end 115 of the bracket 110 is configured for mounting to the inner rail wall 47 described above and therefore projects inwardly from this rail wall 47 generally in cantilevered relation therewith. When the brackets 110 are mounted by themselves, the receptacle units 112 may be mounted on the free end thereof through the mounting apertures 116 (FIGS. 28 and 30).

These brackets 110 also may be inverted for supporting the cross-rail 17A thereon. In particular, the inner end 117 of the bracket 115 includes a support flange 118 having a slot 119 therein that serves the same function as the slots 97 and 98 described above. In particular, the slots 119 are used to mount the rail 17A thereto as illustrated in FIG. 27 which cross-rail 17A thereby spans the distance between the inner ends 117 of the pair of horizontally aligned brackets 115 to which the power distribution assembly 111 is mounted. The bracket 115 further includes side flanges 120 which are stepped a shallow distance inwardly of the bracket side wall 114 so as to abut against and cooperate with the side flanges 109A located on the cross-rail side walls 103A (FIG. 27).

As to the power distribution assembly (PDA) 111, this PDA 111 includes a main cross-rail 121 on which is supported power blocks 122 at the opposite ends thereof in a conventional configuration which power blocks 122 allow for the connection of additional power distribution components thereto such as the flex connector 123 (FIG. 27). This mounting assembly of the brackets 110 and the cross-rail 17A thereby provides an improved support arrangement for power and communication cabling components.

Figure 31:
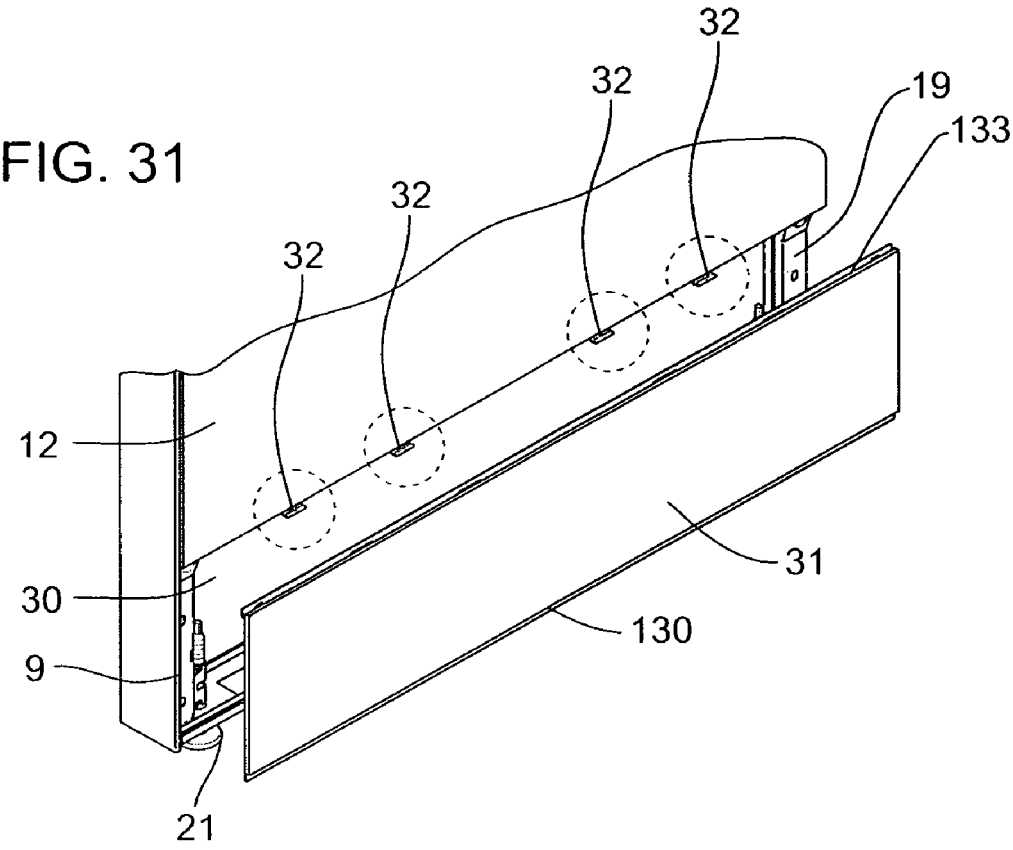
FIG. 31 is a fragmentary perspective view of a base raceway cover and associated wall panel.
Figure 32:
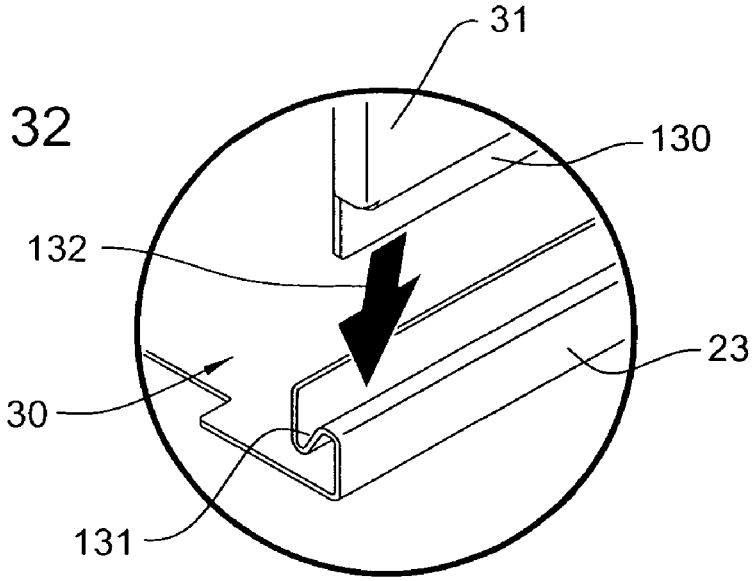
FIG. 32 is an enlarged fragmentary view illustrating the raceway cover being mounted to a bottom pan of the wall panel frame.
Figure 33:
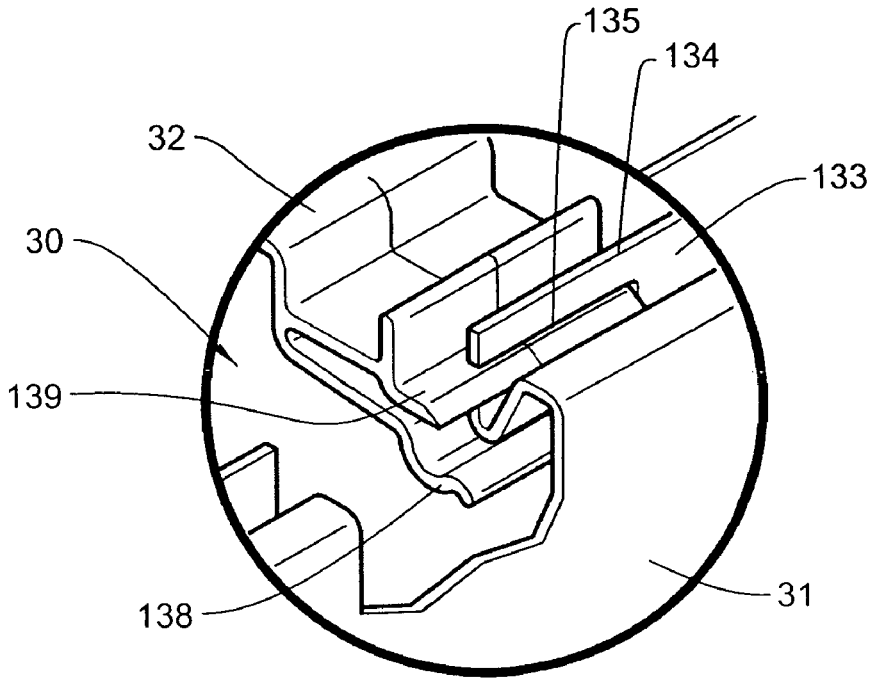
FIG. 33 is an enlarged fragmentary view illustrating the upper edge of the base raceway cover being mounted to a connector clip therefor.

The wall panel assembly of the invention further is configured so as to allow for the connection of either a bottom-most cover tile 12A (FIG. 4) thereto in a base position next to the floor or if a shorter cover tile 12 is used, the panel frame 11 allows for the mounting of the base raceway covers 31 thereto in the lowermost or base position. As to these raceway covers 31, these covers 31 are adapted to mount to the bottom pan 21 and associated connectors 32 as seen in FIG. 31. Referring to FIG. 32, the raceway cover 31 includes a bottom mounting flange 130 which is adapted to slidably fit downwardly into the corresponding slot 131 formed in the pan side flanges 23 as indicated by reference arrow 132. This secures the bottom edge of the base raceway cover securely on the bottom pan 21. As for the upper cover edge 133 (FIGS. 31, 33 and 34), the upper edge 133 of the raceway cover 31 is turned inwardly to define a connector flange 134 that is provided with a plurality of connector slots 135 in horizontally spaced relation.

Figure 34:
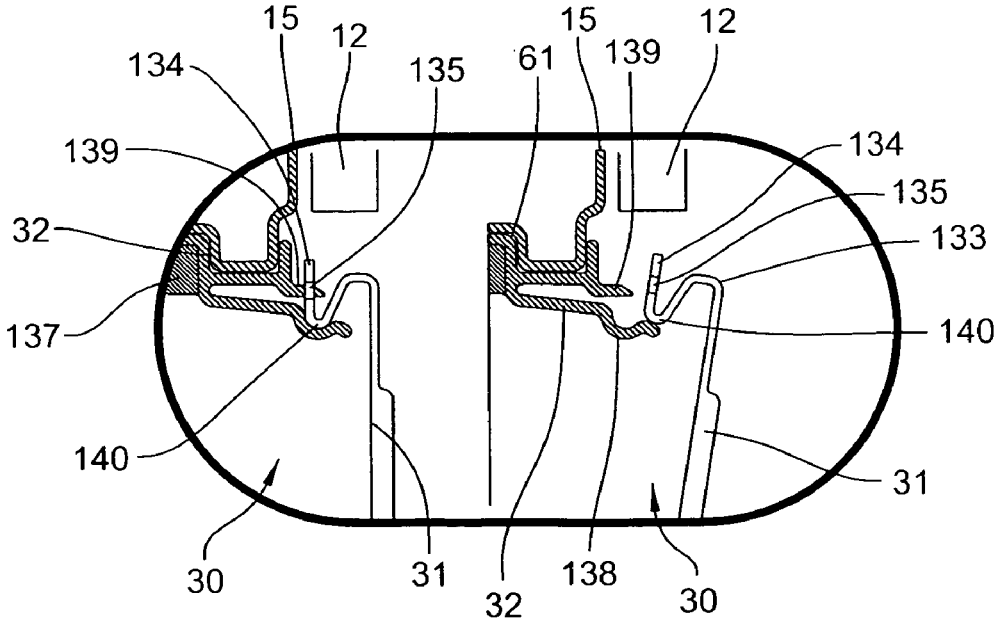
FIG. 34 is an enlarged end view illustrating the connection of the raceway cover top edge to the connector clip.

In this regard, the bottom frame rail 15 (FIG. 34) includes a connector clip 32 that mounts to the bottom of the horizontal frame rail 15. This connector clip 32 includes a center mounting portion 137 that mounts to the bottom of the frame rail 15 and in particular within the longitudinal recess 61 thereof. The main clip body 137 then includes a resiliently cantilevered seat 138 and a catch 139 spaced vertically thereabove. The cantilevered seat 138 is able to flex downwardly as indicated by the mounting illustrations of FIGS. 33 and 34 wherein the bottom edge 140 of the cover tile flange 134 slides over this seat 138 and deflects same downwardly as indicated in FIG. 34. As the raceway cover 31 is rotated inwardly towards the frame, each connector slot 135 thereof then receives the respective catch 139 and securely snaps into position as illustrated on the left side of FIG. 34. In this manner, the base raceway cover may be mounted in position so as to overlie and selectively enclose the raceway 30.

Figure 35B:
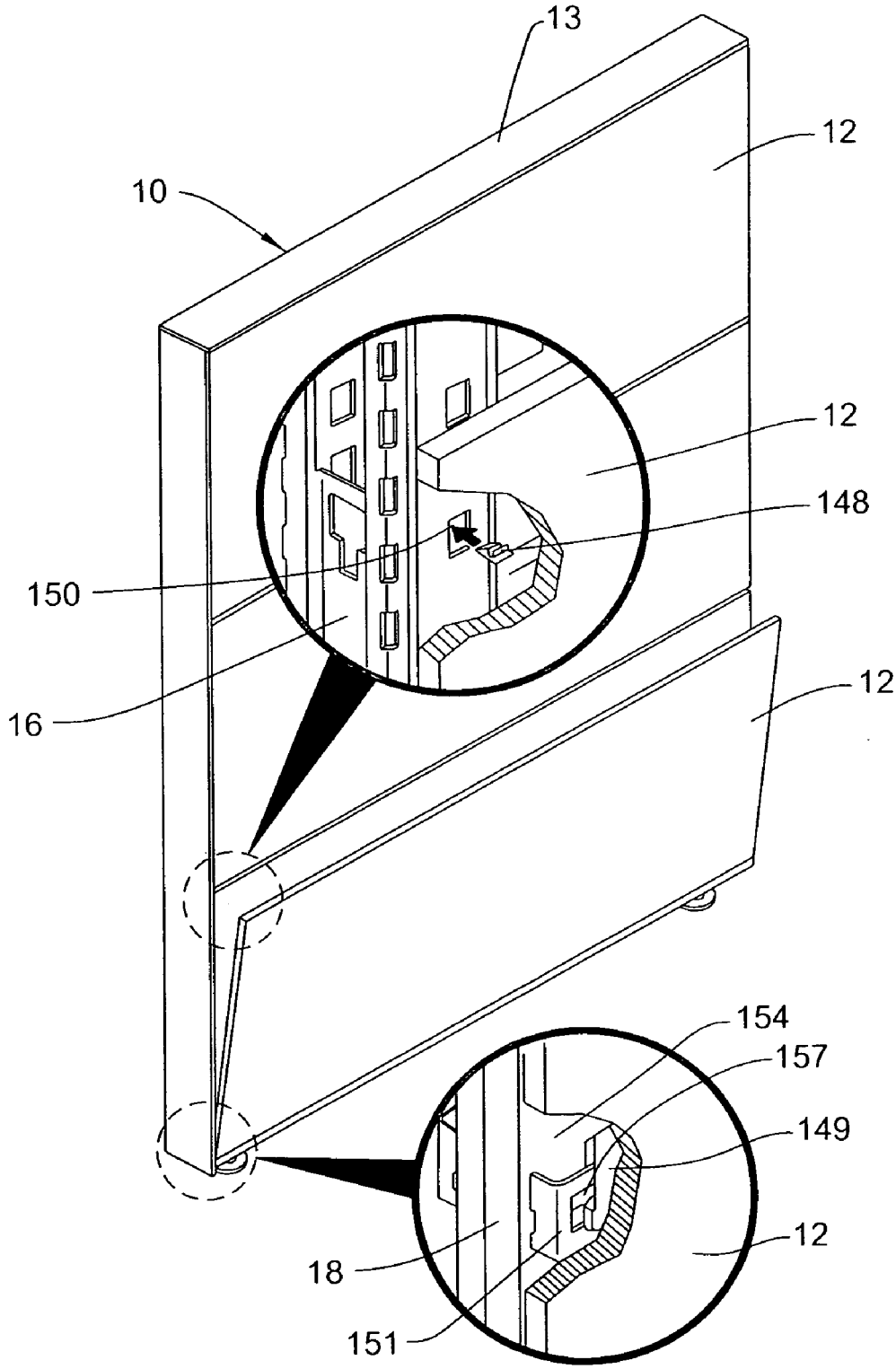
FIG. 35B is a perspective view illustrating a cover tile being mounted in the base position.

Referring to FIG. 35B, the base raceway cover 31 alternatively may be replaced with a base cover tile 12 as seen in FIG. 35B. In particular, an alternative mounting structure is provided on the panel frame 11 that is used for the base cover tile 12 which has clips 148 and 149 instead of the aforementioned bottom pan slot 131 and connector clips 32. In particular, for the upper edge of the cover tile 12, the frame rail side walls 46 are provided with apertures 150 which engage connector clip 148.

Figure 37:
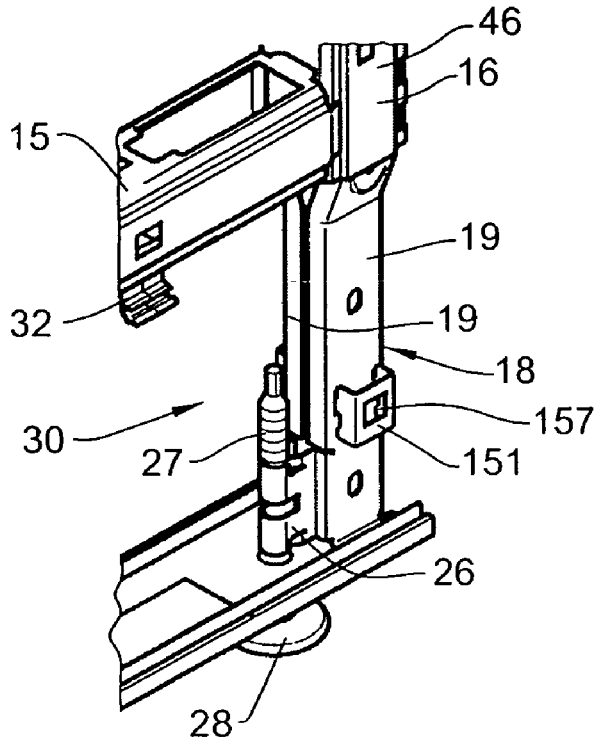
FIG. 37 is an enlarged fragmentary perspective view of the leg support bracket arrangement and a connector clip for the cover tile.
Figure 38:
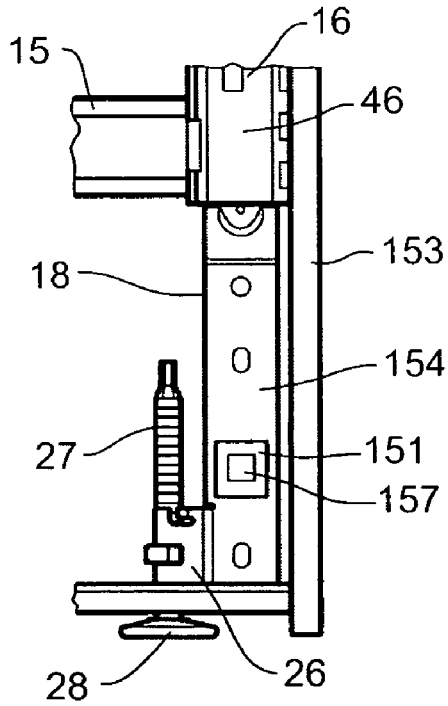
FIG. 38 is a front elevational view thereof.
Figure 39:
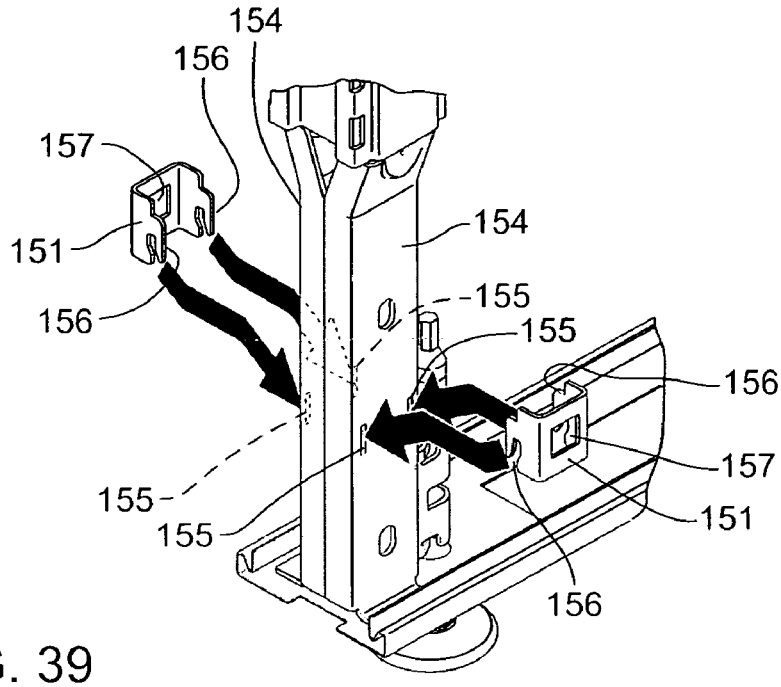
FIG. 39 is an exploded fragmentary perspective thereof.

For the bottom of the cover tile 12, the lower leg parts 18 are provided with connector clips 151 removably mounted thereto that engage with connector clip 149. As seen in FIGS. 36 and 37, the leg parts 18 are each formed from the side members 19 that fit upwardly into the lower end of the vertical frame rail 16. Notably, these leg parts 18 are narrowed in the front to back direction to define cable passages 152 on the opposite sides thereof that allow cabling to pass from the raceway 30 over the side members 19 typically when the base raceway is enclosed by the covers 31. However, the panel illustrated in FIGS. 35A and 38 would not include cabling exiting from the left end since an end trim cover 153 is mounted to the free end of the panel frame 11. Hence, the base cover tile 12 is provided so as to extend downwardly to floor level. While the upper end of the cover tile 12 may readily mount to openings 150 in the side frame rail walls 46, the narrowed leg part 18 requires additional structure to be able to secure to the cover tile 12 without requiring that the cover tile 12 have a different construction from the upper cover tiles 12. In particular, the connector clips 151 serve as horizontal spacers which project outwardly of the side face 154 of the leg part 18. More particularly as seen in FIG. 39, these leg part faces 154 include a pair of mounting slots 155 for the mounting of each clip 151. The clips 151 are provided with corresponding hooks 156 which fit into the slots 155. Additionally, the body of the clip 151 also includes a connector opening 157 to which the corresponding clip 149 on the cover tile 12 would be secured wherein the openings 150 and 157 lie in the same vertical plane so that the cover tiles 12 have the same construction and are mountable at any elevation. In this manner, the upper and lower edges of the cover tile 12A readily mount to the wall panel frame through the openings 50 and 157.

Figure 40:
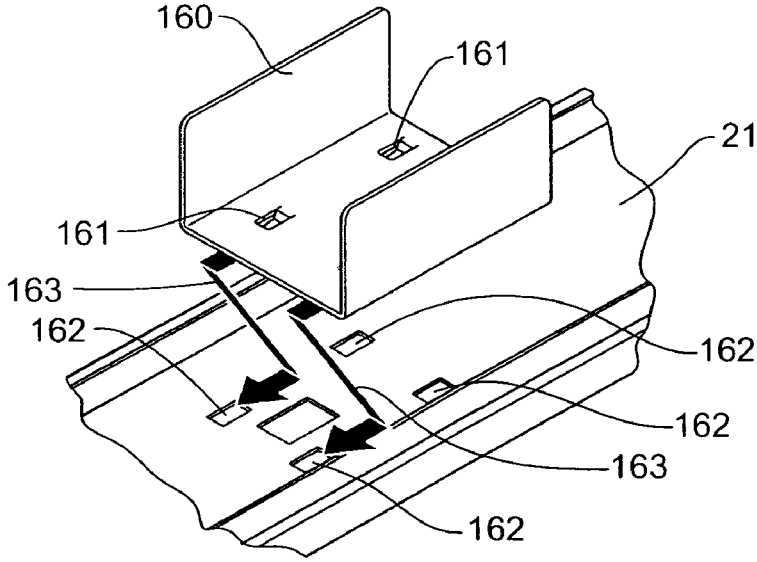
FIG. 40 is an enlarged fragmentary perspective view illustrating a tile support bracket being mounted to the bottom pan.

As to FIG. 40, FIG. 40 illustrates an additional support bracket 160 located intermediately along the length of the bottom pan 21. This support bracket 160 includes hook-like tabs 161 that fit into corresponding openings 162 in the bottom pan 21 as indicated by reference arrows 163. As the bracket 160 is fitted into the openings 162 and then shifted sidewardly, the clips 161 secure the bracket 160 to the bottom pan 21 for connecting to and supporting the middle portion of the cover tile 12.

With the foregoing frame structure, an improved wall panel arrangement is provided.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An upright space-dividing wall panel comprising:

a rigid internal frame which includes upright vertical frame rails and horizontally elongate horizontal frame rails extending between and joined to said vertical frame rails to define an open frame interior, the internal frame having a horizontal frame length defined by the distance between the vertical frame rails;

a plurality of side covers attached to opposite vertical faces of said frame, said side covers being positionable sidewardly adjacent to each other wherein adjacent edges of said adjacent covers define a joint therebetween, said side covers having connectors which engage said vertical frame rails in a vertical mounting plane;

said frame further defining an open raceway area within said frame interior which allows for the storage and passage of cabling within said frame interior, said vertical frame rails including a narrowed leg portion projecting vertically which has a thickness defined between opposite leg side faces that is narrower than the thickness of the vertical frame rails so as to define side passages which open sidewardly from said frame to permit cables to pass into the raceway, said leg portion including a connector clip removably mounted to a leg side face so as to project outwardly therefrom, said connector clip having a horizontal clip length that is substantially smaller than said horizontal frame length and including a connector part which is spaced outwardly from the leg side face and lies in said vertical mounting plane to permit mounting of one of said covers thereto.

2. A wall system according to claim 1, wherein said connector clip has engagement parts that removably connect to corresponding engagement parts in said leg side face.

3. A wall system according to claim 2, wherein said vertical frame rails and said connector clip have openings therein to which said side covers are connected, said openings of said vertical frame rails and said connector clip lying in said vertical mounting plane.

4. A wall system according to claim 1, which further includes a base raceway cover that overlies said raceway vertically adjacent to said side covers, said base raceway cover including raceway cover connectors that engage said frame separate from said connectors for said side covers.

5. A wall system according to claim 4, wherein said connector clip is removable from said leg portion when said base raceway cover is mounted in position.

6. A wall system according to claim 5, wherein said raceway area is positioned at the lowermost portion of said frame and wherein the raceway area is covered by either said raceway cover or said side cover.

7. A wall system according to claim 1, wherein each said leg portion defines a first leg side face and a second leg side face, a first connector clip being removably mounted to said first leg side face and a second connector clip separately and removably mounted to said second leg side face.

8. The wall system according to claim 1, and further including a bottom pan attached to said narrowed leg portion, said bottom pan spaced vertically from said connector clip.

9. An upright space-dividing wall panel system comprising:

a frame comprising:

a pair of upright frame rails disposed in sidewardly spaced relation for defining opposite upright edges of the frame, said upright frame rails having a cross sectional profile comprising a lengthwise outer rail portion and comprising a lengthwise inner rail portion adjacent the interior of said frame, at least one horizontal cross rail having opposite ends rigidly joined to and extending generally horizontally sidewardly between said inner rail portions of said upright frame rails, said cross rail having a lengthwise outer rail portion defined by first side faces and comprising a lengthwise inner rail portion adjacent said frame interior, a plurality of side covers attached to opposite vertical faces of said frame, said side covers being positionable adjacent to each other wherein adjacent edges of said adjacent covers define a joint therebetween, said side covers having cover connectors which engage openings formed in said upright frame rails in a vertical mounting plane;

said frame further defining an open raceway area within said frame interior which allows for the storage and passage of cabling within said frame interior, said raceway area extending along a bottom edge of said frame, said frame including a narrowed leg portion which extends downwardly through said raceway area and is capable of bearing a load, said narrowed leg portion having a thickness that is narrower than the thickness of the upright frame rails; and a connector bracket removably mounted to the frame near said bottom edge and having a horizontal length that is substantially smaller than said horizontal frame length, said connector bracket having a bracket body overlying said raceway area and having at least one aperture formed in said bracket body removably receiving one of said side cover connectors of a lower one of said side covers positioned to overlie said raceway area along said bottom edge wherein said bracket body is spaced outwardly of said narrowed leg portion such that said openings and said aperture lie in said vertical mounting plane and are vertically aligned.

10. A wall panel system according to claim 9, further comprising a base raceway cover that overlies said raceway vertically adjacent to said side covers, said base raceway cover including raceway cover connectors that engage said frame separate from said connectors for said side covers.

11. A wall panel system according to claim 10, wherein said raceway area is positioned at the lowermost portion of said frame and wherein the raceway area is covered by either said raceway cover or said side cover.

12. A wall panel system according to claim 9, wherein said upright frame rail portions are defined by first side faces which define a first thickness of said upright frame rail and said inner rail portion which is defined by second side faces which define a second thickness of said upright frame rail which is less than said first thickness.

13. A section of an upright space-dividing wall panel system comprising:

a rigid internal frame which includes sidewardly-spaced, upright vertical frame rails having outer edges which define a vertical frame rail thickness and having connection apertures therein which lie in a vertical mounting plane, and horizontally elongate horizontal frame rails extending sidewardly between and joined to said vertical frame rails to define an open frame interior, and a bottom pan below said horizontal frame rails defining a bottom frame edge, the internal frame having a horizontal frame length defined by the sideward distance between the vertical frame rails, the vertical frame rails defining outer edges of the section of the upright space-dividing wall panel system;

a plurality of side covers attached to said frame, said side covers being positionable adjacent to each other, said side covers having connectors which engage said vertical frame rail connection apertures to permit connection of a lower one of said side covers to said frame either at said bottom frame edge or spaced vertically above said bottom frame edge;

said frame further defining an open raceway area within said frame interior which allows for the storage and passage of cabling within said frame interior, and including a leg adjacent a said vertical frame rail and projecting vertically within said raceway area and is capable of bearing a load and having a thickness narrower than the vertical frame rail thickness; and a connector bracket mounted to said frame and positioned adjacent said leg, said connector bracket including a bracket body overlying said raceway area and having an aperture that lies in said vertical mounting plane to removably receive a said side cover connector and permit mounting of a lower one of said side covers to said connector bracket so as to position said side cover over said raceway area and said leg, wherein said bracket body is spaced outwardly of said leg such that said vertical frame rail connection apertures and said connector bracket aperture lie in said vertical mounting plane and are vertically aligned.

14. A section of a wall panel system according to claim 13, wherein said raceway area is positioned at the lowermost portion of said frame and wherein the raceway area is covered by either said raceway cover or said side cover.

15. A section of a wall panel system according to claim 13, wherein said connector bracket aperture has a square shape.

16. A section of a wall panel system according to claim 13, wherein said connector bracket has a face plate defined by said bracket body which lies in said vertical mounting plane and is spaced outwardly from said leg within said raceway area.

17. A section of a wall panel system according to claim 13, wherein said lower side cover has a said side cover connector at a lower cover edge which is located so as to be engagable with either said vertical frame rail connection aperture or said connector bracket aperture depending upon a vertical elevation of said lower side cover.

* * * * *